US010752327B2

(12) United States Patent
Mizutani

(10) Patent No.: US 10,752,327 B2
(45) Date of Patent: Aug. 25, 2020

(54) STEERING SYSTEM FOR VESSEL

(71) Applicant: YAMAHA HATSUDOKI KABUSHIKI KAISHA, Iwata-shi, Shizuoka (JP)

(72) Inventor: Makoto Mizutani, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 16/683,392

(22) Filed: Nov. 14, 2019

(65) Prior Publication Data

US 2020/0079484 A1 Mar. 12, 2020

Related U.S. Application Data

(63) Continuation of application No. 15/143,163, filed on Apr. 29, 2016, now Pat. No. 10,518,857.

(30) Foreign Application Priority Data

Apr. 30, 2015 (JP) ..... 2015-093294

(51) Int. Cl.
*B63H 20/12* (2006.01)
*B63H 25/52* (2006.01)
*B63H 25/02* (2006.01)

(52) U.S. Cl.
CPC ..... *B63H 20/12* (2013.01); *B63H 25/52* (2013.01); *B63H 2025/022* (2013.01)

(58) Field of Classification Search
CPC ..... B63H 20/12; B63H 25/52
See application file for complete search history.

(56) References Cited

U.S. PATENT DOCUMENTS

| | | | | |
|---|---|---|---|---|
| 5,350,326 | A * | 9/1994 | Funami | B63H 21/265 114/144 E |
| 6,868,317 | B2 * | 3/2005 | Okuyama | B63H 25/04 114/144 R |
| 7,140,315 | B2 * | 11/2006 | Okuyama | B63H 20/12 114/144 R |
| 7,404,369 | B2 * | 7/2008 | Tracht | B63B 39/061 114/144 RE |
| 7,512,465 | B2 * | 3/2009 | Gai | B63H 25/02 114/144 R |
| 8,281,728 | B2 * | 10/2012 | Washino | B63H 20/12 114/144 R |
| 10,000,269 | B2 * | 6/2018 | Burk | B63H 25/14 |
| 2007/0197110 | A1 * | 8/2007 | Takada | B63H 20/12 440/53 |
| 2011/0117799 | A1 * | 5/2011 | Harada | B63H 25/20 440/58 |
| 2016/0318592 | A1 * | 11/2016 | Mizutani | B63H 25/52 |

OTHER PUBLICATIONS

Mizutani, "Steering System for Vessel", U.S. Appl. No. 15/143,163, filed Apr. 29, 2016.

* cited by examiner

*Primary Examiner* — S. Joseph Morano
*Assistant Examiner* — Jovon E Hayes
(74) *Attorney, Agent, or Firm* — Keating and Bennett, LLP

(57) ABSTRACT

A steering system for a vessel includes an electric actuator that generates power to rotate a steering wheel, a transmitting mechanism that transmits a rotation of the electric actuator to the steering wheel, and a power supply controller that supplies electric power to the electric actuator according to an input signal that is not based on a rotation of the steering wheel.

18 Claims, 14 Drawing Sheets

FIG. 8

TABLE FOR DETERMINING WHETHER LOW-SPEED CONDITION HOLDS

| INDIVIDUAL CONDITION | DETERMINATION FOR INDIVIDUAL CONDITION | | | |
|---|---|---|---|---|
| -30 DEGREES < ANGLE OF REMOTE CONTROL LEVER < 30 DEGREES | OK | OK | OK | NG |
| ENGINE ROTATION SPEED < 1000rpm | OK | OK | NG | |
| VESSEL SPEED < 10km/h | OK | NG | | |
| DETERMINATION WHETHER IT HOLDS | HOLDS | DOES NOT HOLD | DOES NOT HOLD | DOES NOT HOLD |

FIG. 9

TABLE FOR DETERMINING WHETHER OPERATION CONDITION HOLDS

| INDIVIDUAL CONDITION | DETERMINATION FOR INDIVIDUAL CONDITION | | | | | |
|---|---|---|---|---|---|---|
| TORQUE DIRECTION OF ELECTRIC MOTOR | RIGHT | RIGHT | RIGHT | LEFT | LEFT | LEFT |
| TURNING SPEED OF VESSEL | INCREASE | DECREASE | CONSTANT | INCREASE | DECREASE | CONSTANT |
| DETERMINATION WHETHER IT HOLDS | DOES NOT HOLD | HOLDS | HOLDS | HOLDS | DOES NOT HOLD | HOLDS |

HOLDS: WITH STEERING WHEEL OPERATION
DOES NOT HOLD: WITHOUT STEERING WHEEL OPERATION
INCREASE IN TURNING SPEED: TURNING IN RIGHT DIRECTION
DECREASE IN TURNING SPEED: TURNING IN LEFT DIRECTION

Di, Db
71
1
2
11

Di
Db
71
1
2
11

Di
Db
71
1
2
11

Di, Db
71
1
2
11

STEERING SYSTEM FOR VESSEL

BACKGROUND OF THE INVENTION

1. Field of the Invention

The present invention relates to a steering system for a vessel.

2. Description of the Related Art

JP 2006-199064 A discloses a steering device of an outboard motor for providing a good steering feeling. The steering device includes a hydraulic damper that applies friction to rotation of a steering wheel and limits the rotational angle of the steering wheel.

US 2007/197110 A1 discloses a steering device of an outboard motor capable of switching steering feelings. The steering device includes a hydraulic steering mechanism that turns the outboard motor, an electric steering mechanism that turns the outboard motor, and a switching mechanism that performs switching between the hydraulic and electric systems according to a vessel operator's operation.

US 2011/117799 A1 discloses a steering device of an outboard motor that assists a vessel operator's steering wheel operation by an electric actuator. The steering mechanism includes a power assisting mechanism that generates power according to an operation of a steering wheel by a vessel operator.

WO 2009/026663 A1 discloses a system for remotely operating crafts by using a remote terminal such as a mobile phone connected to the crafts via a wireless communication network.

SUMMARY OF THE INVENTION

A hydraulic steering mechanism for an outboard motor includes a helm pump that converts rotation of a steering wheel to a hydraulic pressure, a hydraulic cylinder that turns the outboard motor by the hydraulic pressure transmitted from the helm pump, and hydraulic piping that transmits the hydraulic pressure of the helm pump to the hydraulic cylinder.

In a vessel provided with such a hydraulic steering mechanism, a retrofit automatic steering device called an autopilot is installed in some cases. A common automatic steering device includes a hydraulic pump interposed in the hydraulic piping of the steering mechanism, an electric motor that drives the hydraulic pump, and a controller that controls the electric motor. By the controller controlling the electric motor etc., the vessel is automatically steered.

However, because the retrofit automatic steering device is large, when the automatic steering device is added to the vessel, on-board space available to a vessel occupant decreases. Particularly, in a small-scale vessel, a space to dispose the automatic steering device cannot be obtained in some cases.

On the other hand, it has been proposed to use an electrical steering mechanism in place of a mechanical steering mechanism. The electrical steering mechanism converts a rotation angle of the steering wheel to a signal, and drives according to the signal an electric actuator that drives the rudder. Therefore, adding a device that outputs a drive signal to drive the electric actuator allows automatically steering the vessel. For example, WO 2009/026663 A1 discloses an autopilot system that automatically steers a vessel by sending a command to an automatic control system from a remote terminal.

Changing a mechanical steering mechanism to an electrical steering mechanism has been proposed in various literature including JP 2006-199064 A. However, when changing the existing steering mechanism (mechanical steering mechanism), it is necessary to change devices and introduce a control system etc. Also, US 2007/197110 A1 proposes the steering device including the mechanical steering mechanism and the electrical steering mechanism, and the switching mechanism that performs switching of the mechanical and electrical mechanisms. However, with this steering device, because it is necessary to provide both steering mechanisms, the structure is complicated, and the electrical steering mechanism must be added.

In addition, the technique to assist a vessel operator's steering wheel operation by an electric actuator has been proposed in many literatures including US 2011/117799 A1. However, the technique described in US 2011/117799 A1 does not relate to automatic steering.

In view of the above, it has not been easy to add an automatic steering function to a mechanical steering mechanism. Further, in an electrical steering mechanism, if addition of an automatic steering function is not scheduled, it is necessary to newly provide an interface or change the control system. Accordingly, it has also not been easy to add an automatic steering function to an electrical steering mechanism.

In order to overcome the previously unrecognized and unsolved challenges described above, a preferred embodiment of the present invention provides a steering system for a vessel. The steering system includes an electric actuator that generates power to rotate a steering wheel, a transmitting mechanism including a driving member that rotates together with an output portion of the electric actuator and a driven member that rotates together with the steering wheel, and that transmits a rotation of the output portion of the electric actuator to the steering wheel, and a power supply controller that supplies electric power to the electric actuator according to an input signal that is not based on a rotation of the steering wheel. The "input signal that is not based on a rotation of the steering wheel" preferably is a signal that is generated even without an operation of the steering wheel by a vessel operator.

According to this arrangement, when an input signal that is not based on a rotation of the steering wheel is generated, the power supply controller supplies electric power to the electric actuator. The electric actuator is thus rotated, and the rotation is transmitted to the steering wheel by the transmitting mechanism including the driving member and the driven member. Therefore, even if the vessel operator is not touching the steering wheel, the steering wheel rotates.

In the case where the steering mechanism is a mechanical type, the rudder is driven when the steering wheel rotates. In the case where the steering mechanism is an electrical type, when the steering wheel rotates, the rotation is sensed, and the electric actuator to turn the rudder is driven. Thus, in either case where the steering mechanism is a mechanical type or an electrical type, the vessel is automatically steered.

In this way, in the present system, an automatic steering function is added by providing the electric actuator, the transmitting mechanism, etc., preferably on the periphery of the steering wheel. It is therefore not necessary to greatly modify the existing steering mechanism. Further, a reduction in on-board space is reduced or minimized because of a simple configuration that rotates the steering wheel.

The vessel preferably includes a console base that rotatably supports the steering wheel. The electric actuator is preferably supported by the console base.

According to this arrangement, the electric actuator is disposed near the steering wheel. That is, the electric actuator and the steering wheel are supported by the same console base. It is thus prevented that the space other than on the periphery of the steering wheel decreases due to the addition of an automatic steering function.

The electric actuator is preferably disposed between the console base and the steering wheel.

According to this arrangement, the steering wheel and the console base oppose each other via a space, and the electric actuator is disposed in the space. That is, the electric actuator preferably is disposed outside of the console base at a position near the steering wheel. Further, because the electric actuator is disposed outside of the console base, the transmitting mechanism is also disposed outside of the console base. It is therefore not necessary to secure a space to dispose the electric actuator and the transmitting mechanism in an interior of the console base.

The steering system preferably further includes a cover that covers both the electric actuator and transmitting mechanism.

According to this arrangement, the electric actuator and the transmitting mechanism are disposed between the steering wheel and the console base, and the cover covers the electric actuator and the transmitting mechanism. Therefore, the electric actuator and the transmitting mechanism are protected from seawater, rainwater, etc.

The driven member is preferably located on a rotation axis of the steering wheel. The driving member is preferably located around the driven member. "The driving member being located around the driven member" means that the driving member and the driven member are arranged in a direction perpendicular or substantially perpendicular to the rotation axis of the steering wheel. In this case, the driving member and the driven member are preferably in contact with each other, or an intermediate member is preferably disposed between the driving member and the driven member.

According to this arrangement, the driven member is located near the rotation axis of the steering wheel. Further, the driving member is located near the driven member. The transmitting mechanism is thus downsized. A reduction in on-board space due to the addition of an automatic steering function is reduced or minimized.

The transmitting mechanism preferably decelerates the rotation of the electric actuator between the electric actuator and the steering wheel only one time.

According to this arrangement, the rotation of the electric actuator is decelerated only one time between the electric actuator and the steering wheel. When the rotation of the electric actuator is decelerated a plurality of times, a plurality of reduction gears are required. Therefore, the transmitting mechanism is increased in size. On the other hand, when the rotation of the electric actuator is not decelerated, an electric actuator having a large rated torque, that is, a large-sized electric actuator is required. Therefore, according to this arrangement, an increase in size of the electric actuator and the transmitting mechanism is reduced or minimized.

The transmitting mechanism preferably couples the electric actuator to the steering wheel at all times. The "coupling at all times" means such coupling that, when one of the electric actuator and steering wheel rotates, the other of the electric actuator and steering wheel accordingly rotates at any time.

When a power transmission path connecting the electric actuator and the steering wheel with each other is disconnected and connected by an electromagnetic clutch, it is necessary to switch the electromagnetic clutch. In contrast, when the electric actuator is coupled at all times to the steering wheel, such switching control is unnecessary. Thus, the steering system is simplified.

The transmitting mechanism preferably further includes a clutch that transmits the power of the electric actuator toward the steering wheel on a power transmission path connecting the electric actuator and the steering wheel with each other and disconnects the transmission path when a vessel operator applies torque to the steering wheel.

According to this arrangement, torque in a normal rotation direction and a reverse rotation direction is transmitted from the electric actuator to the steering wheel via the clutch. On the other hand, when the vessel operator applies torque in the normal rotation direction and the reverse rotation direction to the steering wheel, the clutch disconnects the transmission path. Therefore, when the vessel operator operates the steering wheel, no inertial resistance or electrical braking force of the electric actuator is transmitted to the vessel operator via the steering wheel. Therefore his/her steering feeling is prevented from worsening.

The maximum torque that is transmitted from the electric actuator to the steering wheel is preferably about 8 Nm (newton meter) or less, for example.

According to this arrangement, a rated torque of the electric actuator and a reduction ratio of the transmitting mechanism are set so that the maximum torque that is transmitted from the electric actuator to the steering wheel preferably becomes about 8 Nm or less, for example. The maximum torque is not less than the minimum torque necessary to rotate the steering wheel when the vessel operator is not touching the steering wheel and less than the minimum torque necessary to rotate the steering wheel when the vessel operator is touching the steering wheel.

In this way, because the maximum torque is small, when drive of the steering wheel by the electric actuator and an operation of the steering wheel by the vessel operator are carried out at the same time, the operation of the steering wheel by the vessel operator is prioritized. Thus, the operation of the steering wheel by the vessel operator is reliably reflected in the steering of the vessel. Further, because the maximum torque is small, a small motor can be used as the electric actuator. Therefore, a volume occupied by the electric actuator is able to be reduced, so that the electric actuator is able to be reduced in power consumption.

The power supply controller preferably supplies electric power to the electric actuator only when the vessel is at a speed of a predetermined value or less. For example, the power supply controller preferably supplies electric power to the electric actuator only when an engine that generates power to propel the vessel is at a rotation speed of about 1000 rpm or less.

When the steering mechanism is a mechanical type and the vessel is at high speed, because a high water pressure is applied to the rudder, the steering wheel does not move unless a large torque is applied to the steering wheel. It is therefore necessary to use a motor having a large rated torque as the electric actuator. This means that the electric actuator is increased in size to increase power consumption.

In contrast, when the electric actuator rotates the steering wheel only when the vessel is at low speed, it is not necessary to use a motor having a large rated torque as the electric actuator. Therefore, a volume occupied by the electric actuator is reduced, so that the electric actuator is reduced in power consumption.

A controller of the power supply controller preferably is configured or programmed to include an actuator driver that controls the electric power supply to the electric actuator, an operation detector that determines whether an operation condition including that a vessel operator is operating the steering wheel holds, and a drive stopper that causes the actuator driver to stop the drive of the electric actuator if the operation condition holds when the electric actuator is being driven.

According to this arrangement, it is determined when the electric actuator is being driven whether the vessel operator is operating the steering wheel, that is, whether the vessel operator keeps the steering wheel at a constant position or whether the vessel operator is rotating the steering wheel. When it is determined that the vessel operator is operating the steering wheel, the drive of the electric actuator is stopped, and the transmission of torque from the electric actuator to the steering wheel is stopped. Thus, it is prevented that the electric actuator prevents the vessel operator from steering the wheel.

The controller of the power supply controller preferably includes a modifying angle calculator that calculates a rotation angle of the electric actuator according to the input signal, and an actuator driver that controls the electric power supply to the electric actuator so that the electric actuator rotates at the rotation angle calculated by the modifying angle calculator.

The controller preferably further includes a communicator that is connected via a wireless communication network to a mobile terminal to be operated by a vessel operator and receives the input signal sent from the mobile terminal.

According to this arrangement, a command input to the mobile terminal by the vessel operator is received by the communicator via the wireless communication network, and the controller controls the electric power supply to the electric actuator based on the command received by the communicator. Because the mobile terminal is not physically connected to the steering system, the vessel operator is able to provide an instruction to the controller from any place on board. That is, the vessel operator is able to remotely operate the automatic steering device. Further, because an operated section and display section necessary for an automatic steering function can be omitted, the console base is able to be simplified.

The mobile terminal preferably includes an operated section that is operated when a vessel operator designates a destination of the vessel. The power supply controller preferably controls the electric power supply to the electric actuator so as to control a course of the vessel so that the vessel is headed to the destination designated by the mobile terminal. That is, an autopilot function is preferably provided for the steering system. In this case, it is preferable that the mobile terminal further includes a GPS that calculates a current position of the mobile terminal based on a signal sent by a GPS satellite. This is because a current position of the mobile terminal equivalent to a current position of the vessel is able to be more accurately grasped.

The steering system preferably further includes a wind direction detector that detects an inclination angle of a bow direction with respect to a wind direction to generate the input signal.

According to this arrangement, the wind direction detector generates an input signal indicating an inclination angle of the bow direction with respect to the wind direction. The power supply controller supplies electric power to the electric actuator according to the input signal generated by the wind direction detector. The bow is thus automatically directed toward the wind. Thus, even if the vessel operator does not operate the steering wheel, the bow is automatically directed toward the wind.

The steering system preferably further includes a power supply circuit that connects the electric actuator to a battery, and a wind direction detector that detects an inclination angle of a bow direction with respect to a wind direction. The power supply controller preferably further includes a power supply switch that controls an electric power supply from the power supply circuit to the electric actuator, a drive circuit that transmits to the power supply switch the input signal to supply electric power from the power supply circuit to the electric actuator, and a drive switch that, according to the inclination angle of the bow direction with respect to the wind direction detected by the wind direction detector, switches to an ON-state to generate the input signal and an OFF-state to open the drive circuit.

According to this arrangement, when the inclination angle of the bow direction with respect to the wind direction becomes a predetermined value, the drive switch becomes the ON-state, and an input signal that is not based on a rotation of the steering wheel is transmitted from the drive circuit to the power supply switch. The electric power of the battery is thus supplied from the power supply circuit to the electric actuator, and the electric actuator is driven. Therefore, the bow is automatically directed toward the wind. Thus, even if the vessel operator does not operate the steering wheel, the bow is automatically directed toward the wind.

The steering system preferably further includes an ON/OFF switch that opens and closes one of the power supply circuit and drive circuit according to a vessel operator's operation.

According to this arrangement, the ON/OFF switch is turned on/off by the vessel operator. Where the ON/OFF switch is provided in the drive circuit, the drive circuit is open when the ON/OFF switch is off, so that no input signal is generated. Where the ON/OFF switch is provided in the power supply circuit, the power supply circuit is open when the ON/OFF switch is off, so that the supply of electric power from the power supply circuit to the electric actuator is shut off. Therefore, the vessel operator is able to validate and invalidate the automatic steering function by operating the ON/OFF switch.

The steering system preferably further includes a direction detector that detects an inclination angle of a bow direction with respect to a magnetic field direction to generate the input signal.

According to this arrangement, the direction detector generates an input signal indicating an inclination angle of the bow direction with respect to a magnetic field direction. The power supply controller supplies electric power to the electric actuator according to the input signal generated by the direction detector. The bow is thus automatically directed toward a preset direction. Thus, even if the vessel operator does not operate the steering wheel, a state where the bow is directed toward the specific direction is maintained.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 8 is a table showing examples of requirements for which a low-speed condition including that the vessel is at low speed holds.

FIG. 9 is a table showing examples of requirements for which an operation condition including that a vessel operator is operating a steering wheel holds.

DETAILED DESCRIPTION OF THE PREFERRED EMBODIMENTS

Figure 1:
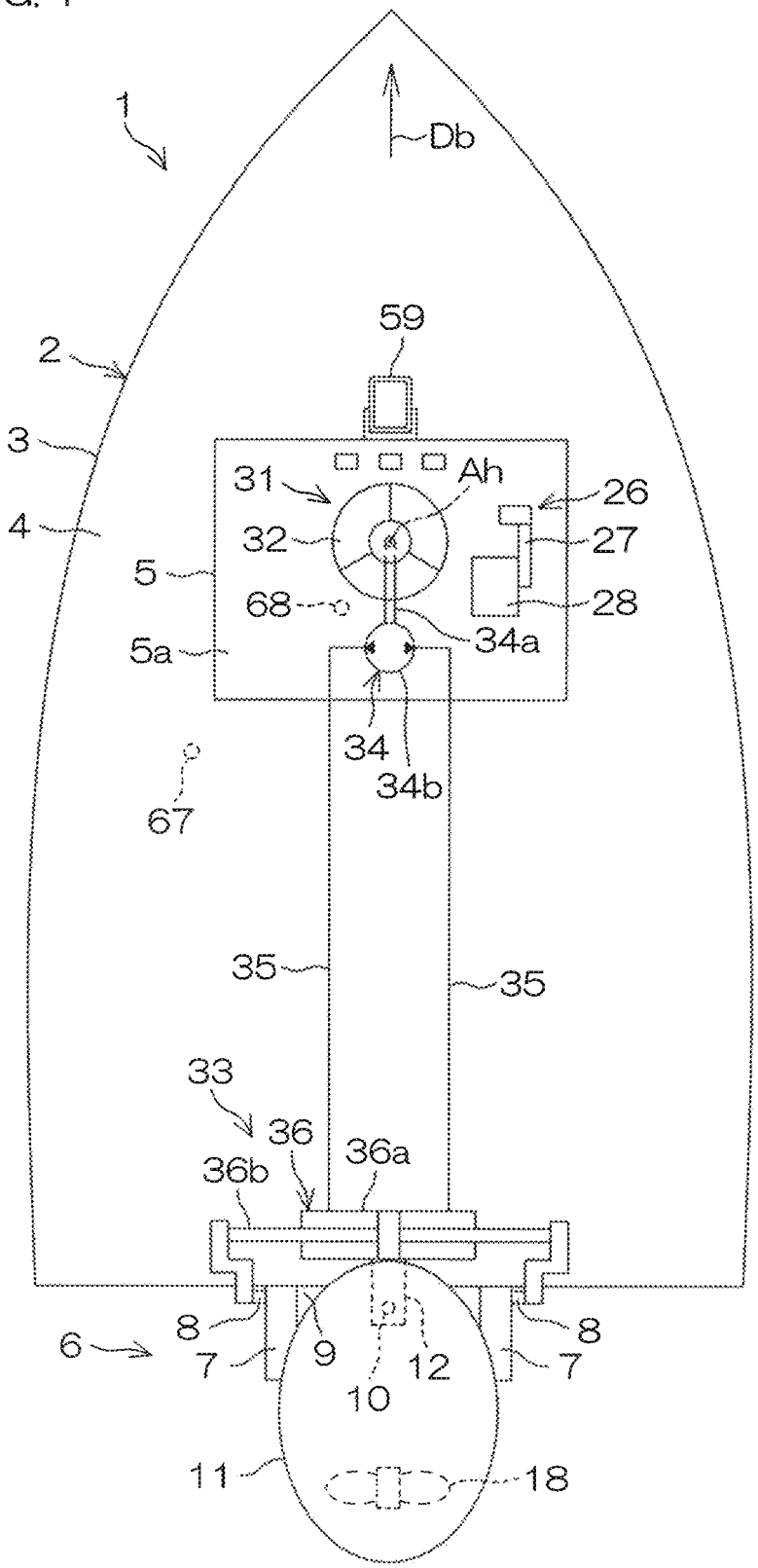
FIG. 1 is a schematic view of a vessel according to a first preferred embodiment of the present invention.
Figure 2:
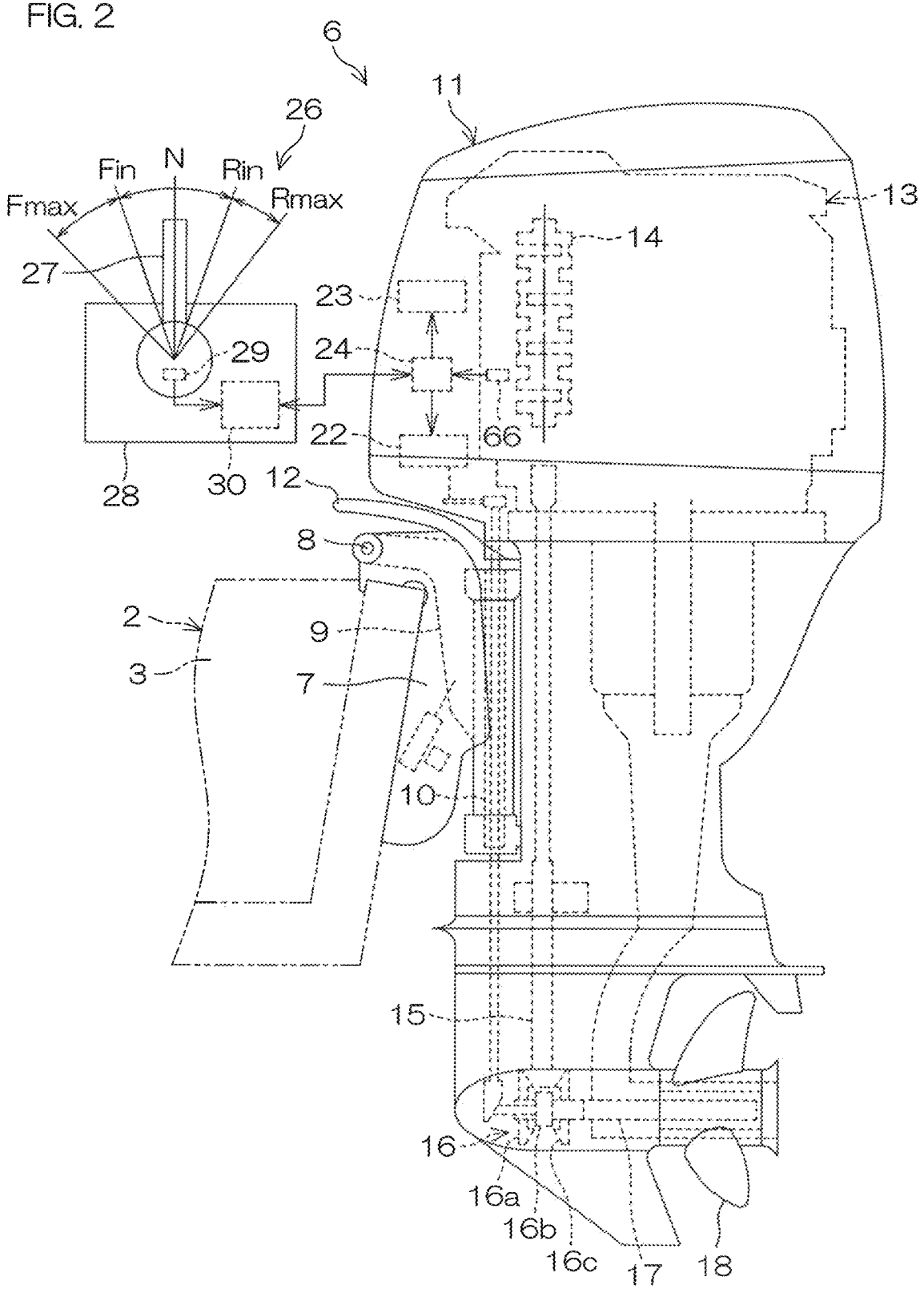
FIG. 2 is a schematic view showing a left side surface of an outboard motor provided in the vessel.

FIG. 1 is a schematic view of a vessel 1 according to a first preferred embodiment of the present invention. FIG. 2 is a schematic view showing a left side surface of an outboard motor 11 provided in the vessel 1.

As shown in FIG. 1, the vessel 1 includes a body 2 that floats on the water and a vessel propulsion apparatus 6 that generates thrust to propel the body 2. The body 2 includes a hull 3 that floats on the water and a deck 4 disposed over the hull 3.

As shown in FIG. 2, the vessel propulsion apparatus 6 includes a clamp bracket 7 that is attachable to a rear portion (stern) of the body 2 and a swivel bracket 9 supported by the clamp bracket 7 so as to be rotatable about a tilting shaft 8 extending in a left-right direction. The vessel propulsion apparatus 6 further includes a steering shaft 10 supported by the swivel bracket 9 so as to be rotatable about a center line of the steering shaft 10 extending in an up-down direction and an outboard motor 11 that rotates in the left-right direction about the steering shaft 10 together with the steering shaft 10.

The outboard motor 11 includes an engine 13 being an example of a prime mover that generates power to rotate a propeller 18 and a power transmission system that transmits the power of the engine 13 to the propeller 18. The engine 13 includes a crankshaft 14 that is rotatable about a rotation axis extending in the up-down direction. A rotation of the crankshaft 14 is transmitted to the propeller 18 via a drive shaft 15, a forward/reverse drive switching mechanism 16, and a propeller shaft 17 of a power transmitting mechanism. A rotation direction of the propeller 18 attached to the propeller shaft 17 is switched by the forward/reverse drive switching mechanism 16.

The forward/reverse drive switching mechanism 16 includes a front gear 16*a* and a rear gear 16*c* that rotate in mutually opposite directions according to a rotation of the drive shaft 15 extending in the up-down direction and a dog clutch 16*b* that rotates about the propeller shaft 17 extending in the front-rear direction together with the propeller shaft 17. The dog clutch 16*b* that is movable in an axial direction of the propeller shaft 17 with respect to the propeller shaft 17 is selectively disposed at any of a forward drive position to engage with the front gear 16*a*, a reverse drive position to engage with the rear gear 16*c*, and a neutral position to engage with neither of the front gear 16*a* nor the rear gear 16*c*.

The outboard motor 11 includes a shift actuator 22 that generates power to move the dog clutch 16*b* to any of the shift positions and a throttle actuator 23 that changes the opening degree of a throttle valve to adjust the output of the engine 13. The shift actuator 22 and the throttle actuator 23 are both electric actuators that are controlled by an outboard motor ECU (Electronic Control Unit) 24 of the vessel propulsion apparatus 6. Electrical equipment provided in the vessel propulsion apparatus 6 is connected to the outboard motor ECU 24.

As shown in FIG. 1, the vessel 1 includes a steering wheel 32 that is rotated by a vessel operator to steer the vessel 1 and a remote controller 26 that is tilted in the front-rear direction by the vessel operator to adjust the output of the engine 13 and switch a travelling direction of the vessel 1 between a forward driving direction and a reverse driving direction.

The steering wheel 32 and the remote controller 26 are supported by a console base 5 that is disposed in front of the vessel operator. The steering wheel 32 is rotatable with respect to the console base 5. The console base 5 includes a console surface 5*a* disposed on a plane that crosses a rotation axis Ah of the steering wheel 32. The console base 5 projects upward from the deck 4 where the vessel operator moves. A switch such as a start switch to start the engine 13 and a meter such as a tachometer to display a rotation speed of the engine 13 are installed in the console base 5 at positions within a vessel operator's field of vision.

The remote controller 26 includes a remote control lever 27 that defines and functions both as a throttle member to adjust the output of the vessel propulsion apparatus 6 and a shift member to switch the forward drive and reverse drive of the vessel 1 and a remote control box 28 that supports a root portion of the remote control lever 27 so that the remote control lever 27 is inclinable in the front-rear direction. The remote controller 26 may be provided with a throttle member and a shift member that are independent of each other, in place of the remote control lever 27.

As shown in FIG. 2, the remote control lever 27 is inclinable in the front-rear direction between an F full-open position Fmax where it is most forwardly tilting and a R full-open position Rmax where it is most rearwardly tilting. The range from the F full-open position Fmax to an F switching position Fin is an "F-range" in which the vessel propulsion apparatus 6 generates a thrust in the forward driving direction. The range from the R full-open position Rmax to a R switching position Rin is a "R-range" in which the vessel propulsion apparatus 6 generates a thrust in the reverse driving direction. The range between the F switching position Fin and the R switching position Rin is an "N-range" in which the vessel propulsion apparatus 6 generates no thrust. A neutral position N is, for example, a position in between the F switching position Fin and the R switching position Rin.

When the remote control lever 27 is forwardly tilted up to the F switching position Fin, the vessel propulsion apparatus 6 is switched so as to generate a thrust in the forward driving direction. When the remote control lever 27 is rearwardly tilted up to the R switching position Rin, the vessel propulsion apparatus 6 is switched so as to generate a thrust in the reverse driving direction. When the remote control lever 27 is titled farther forwardly from the F switching position Fin, the output of the vessel propulsion apparatus 6 is increased according to the tilt angle of the remote control lever 27. The same applies in the case of reverse driving.

The remote controller 26 includes a lever position detector 29 that detects a position of the remote control lever 27 and a remote control ECU 30 that outputs a shift changing signal to shift the outboard motor 11 and an output changing signal to change the outboard motor 11 in output according to a detection value of the lever position detector 29. The remote control ECU 30 is connected to the outboard motor ECU 24 by wiring. The outboard motor ECU 24 drives the shift actuator 22 and the throttle actuator 23 according to a signal transmitted from the remote control ECU 30. Thus, when the vessel operator operates the remote control lever 27, the vessel propulsion apparatus 6 is accordingly operated.

As shown in FIG. 1, a steering system of the vessel 1 includes a manual steering device 31 that steers the vessel 1 according to the vessel operator's operation. The manual steering device 31 includes a steering wheel 32 that is rotated by the vessel operator to steer the vessel 1 and a steering mechanism 33 that drives the outboard motor 11 equivalent to a rudder according to the rotation of the steering wheel 32.

The steering mechanism 33 includes a helm pump 34 (hydraulic pump) that converts the rotation of the steering wheel 32 to a hydraulic pressure, a hydraulic cylinder 36 that turns the rudder by the hydraulic pressure transmitted from the helm pump 34, and hydraulic piping 35 that transmits the hydraulic pressure of the helm pump 34 to the hydraulic cylinder 36. Both end portions of a rod 36*b* of the hydraulic cylinder 36 are coupled to both end portions of the tilting shaft 8, respectively. A cylinder tube 36*a* of the hydraulic cylinder 36 is coupled to a steering arm 12 of the outboard motor 11 that turns about the steering shaft 10 together with the steering shaft 10.

The helm pump 34 includes a pump shaft 34*a* extending along the rotation axis Ah of the steering wheel 32 and a pump housing 34*b* that rotatably supports the pump shaft 34*a*. The helm pump 34 is supported by the console base 5. A center portion of the steering wheel 32 is removably coupled to the pump shaft 34*a*. The pump shaft 34*a* rotates in the same direction as that of the steering wheel 32. The steering wheel 32 may be coupled to the pump shaft 34*a* via another member extending along the rotation axis Ah of the steering wheel 32.

When the vessel operator rotates the steering wheel 32, a hydraulic pressure is generated in the helm pump 34, and the hydraulic pressure of the helm pump 34 is transmitted to the hydraulic cylinder 36 by the hydraulic piping 35. The cylinder tube 36*a* of the hydraulic cylinder 36 thus moves in the left-right direction with respect to the body 2. The linear movement of the cylinder tube 36*a* is converted to a rotation of the steering shaft 10 by the steering arm 12. The outboard motor 11 thus turns in the left-right direction about the steering shaft 10, so that the vessel 1 is steered.

Figure 3:
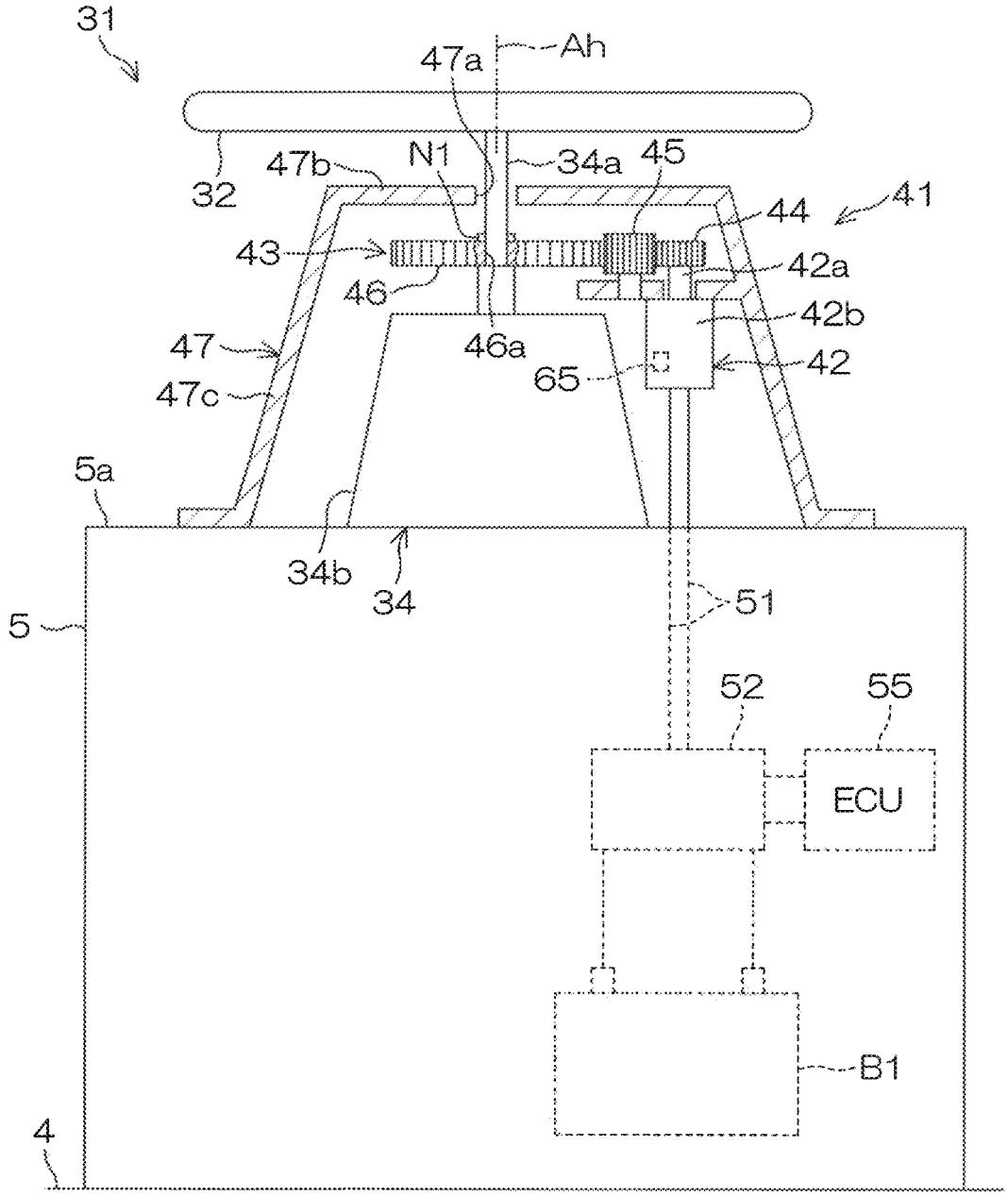
FIG. 3 is a schematic view showing an automatic steering device provided in the vessel.

FIG. 3 is a schematic view showing an automatic steering device 41 provided in the vessel 1.

The steering system of the vessel 1 includes the automatic steering device 41 that automatically steers the vessel 1. The automatic steering device 41 includes an electric motor 42 that generates power to rotate the steering wheel 32, a transmitting mechanism 43 that transmits the power of the electric motor 42 to the steering wheel 32, and a waterproof cover 47 that covers the electric motor 42 and the transmitting mechanism 43.

The electric motor 42 includes a cylindrical motor housing 42*b* that houses a stator and a rotor and a motor shaft 42*a* rotatably supported by the motor housing 42*b*. The electric motor 42 may be supported by the console base 5 via another member such as the waterproof cover 47, or may be directly supported by the console base 5.

The electric motor 42 is disposed between the steering wheel 32 and the console surface 5*a*. The electric motor 42 has a rotation axis that is parallel or substantially parallel to the rotation axis Ah of the steering wheel 32. The motor shaft 42*a* that is equivalent to an output portion of the electric motor 42 projects upward from the motor housing 42*b*. The motor housing 42*b* is located around the rotation axis Ah of the steering wheel 32.

The transmitting mechanism 43 includes a driving gear 44 that rotates together with the motor shaft 42*a* of the electric motor 42 and a driven gear 46 that rotates together with the steering wheel 32. The transmitting mechanism 43 may further include one or more intermediate gears 45 that transmit a rotation of the driving gear 44 to the driven gear 46. FIG. 3 shows an example in which one intermediate gear 45 is disposed between the driving gear 44 and the driven gear 46. The driving gear 44, the intermediate gear 45, and the driven gear 46 are examples of a driving member, an intermediate member, and a driven member, respectively.

The driving gear 44 is coaxial with the motor shaft 42*a*, and the driven gear 46 is coaxial with the pump shaft 34*a*. The driving gear 44 is coupled to the motor shaft 42*a*, and the driven gear 46 is coupled to the pump shaft 34*a*. The intermediate gear 45 is engaged with both of the driving gear 45 and the driven gear 46. The intermediate gear 45 is rotatably supported by the waterproof cover 47.

The driven gear 46 has a center line located on the rotation axis Ah of the steering wheel 32. The driving gear 44 is located around the driven gear 46. The pump shaft 34*a* equivalent to a steering shaft is inserted in a through-hole 46*a* that penetrates through a center portion of the driven gear 46. The driven gear 46 is removably coupled to the pump shaft 34*a* by a ring nut N1. The driven gear 46 is fixed with respect to the pump shaft 34*a* in its axial direction.

The waterproof cover 47 is disposed between the steering wheel 32 and the console surface 5*a*. The waterproof cover 47 is removably coupled to the console base 5. The pump shaft 34*a* projects upward from the waterproof cover 47. The waterproof cover 47 includes an upper wall 47*b* that defines a through-hole 47*a* in which the pump shaft 34*a* is inserted and a peripheral wall 47*c* extending from an outer peripheral portion of the upper wall 47*b* toward the console surface 5*a*. The peripheral wall 47*c* surrounds the helm pump 34, the electric motor 42, and the transmitting mechanism 43. The driving gear 44, the intermediate gear 45, and the driven gear 46 are located under the upper wall 47*b*.

The driving gear 44 rotates in the same direction at the same speed and at the same rotation angle as those of the motor shaft 42*a*. The rotation of the driving gear 44 is transmitted to the driven gear 46 by the intermediate gear 45. When the driven gear 46 rotates, the pump shaft 34*a* rotates in the same direction at the same speed and at the same rotation angle as those of the driven gear 46. The steering wheel 32 thus rotates clockwise or counterclockwise. Also, a hydraulic pressure is generated in the helm pump 34 by the rotation of the pump shaft 34*a*, so that the outboard motor 11 is turned in the left-right direction. The vessel 1 is thus automatically steered even if the vessel operator does not rotate the steering wheel 32.

The driven gear 46 has an outer diameter larger than the outer diameter of the driving gear 44 and smaller than the outer diameter of the steering wheel 32. The driven gear 46 has teeth smaller in number than those of the driving gear 44. The intermediate gear 45 has teeth equal in number to those of the driving gear 44. A rotation of the electric motor 42 is thus not decelerated at an engaging portion between the driving gear 44 and the intermediate gear 45 but is decelerated at an engaging portion between the driven gear 46 and the intermediate gear 45. Therefore, the rotation of the electric motor 42 is decelerated only one time and then transmitted to the pump shaft 34*a*.

The maximum torque that is transmitted from the electric motor 42 to the steering wheel 32 preferably is, for example, about 8 Nm or less. That is, a rated torque of the electric motor 42 and a reduction ratio of the transmitting mechanism 43 are preferably set so that the maximum torque becomes about 8 Nm or less. The maximum torque is not less than the minimum torque necessary to rotate the steering wheel 32 when the vessel operator is not touching the steering wheel 32 and less than the minimum torque necessary to rotate the steering wheel 32 when the vessel operator is touching the steering wheel 32.

Because the maximum torque is thus small, even if the electric motor 42 is driven when the vessel operator is touching the steering wheel 32, the steering wheel 32 does not rotate in a direction in which the electric motor 42 intends to rotate the steering wheel 32. Thus, when drive of the steering wheel 32 by the electric motor 42 and an operation of the steering wheel 32 by the vessel operator are carried out at the same time, the vessel operator's steering wheel operation is prioritized. That is, when the vessel operator keeps the steering wheel 32 at a constant angle, that operation is continued. When the vessel operator intends to rotate the steering wheel 32, the steering wheel 32 rotates in a direction according to the vessel operator's intention.

Figure 4:
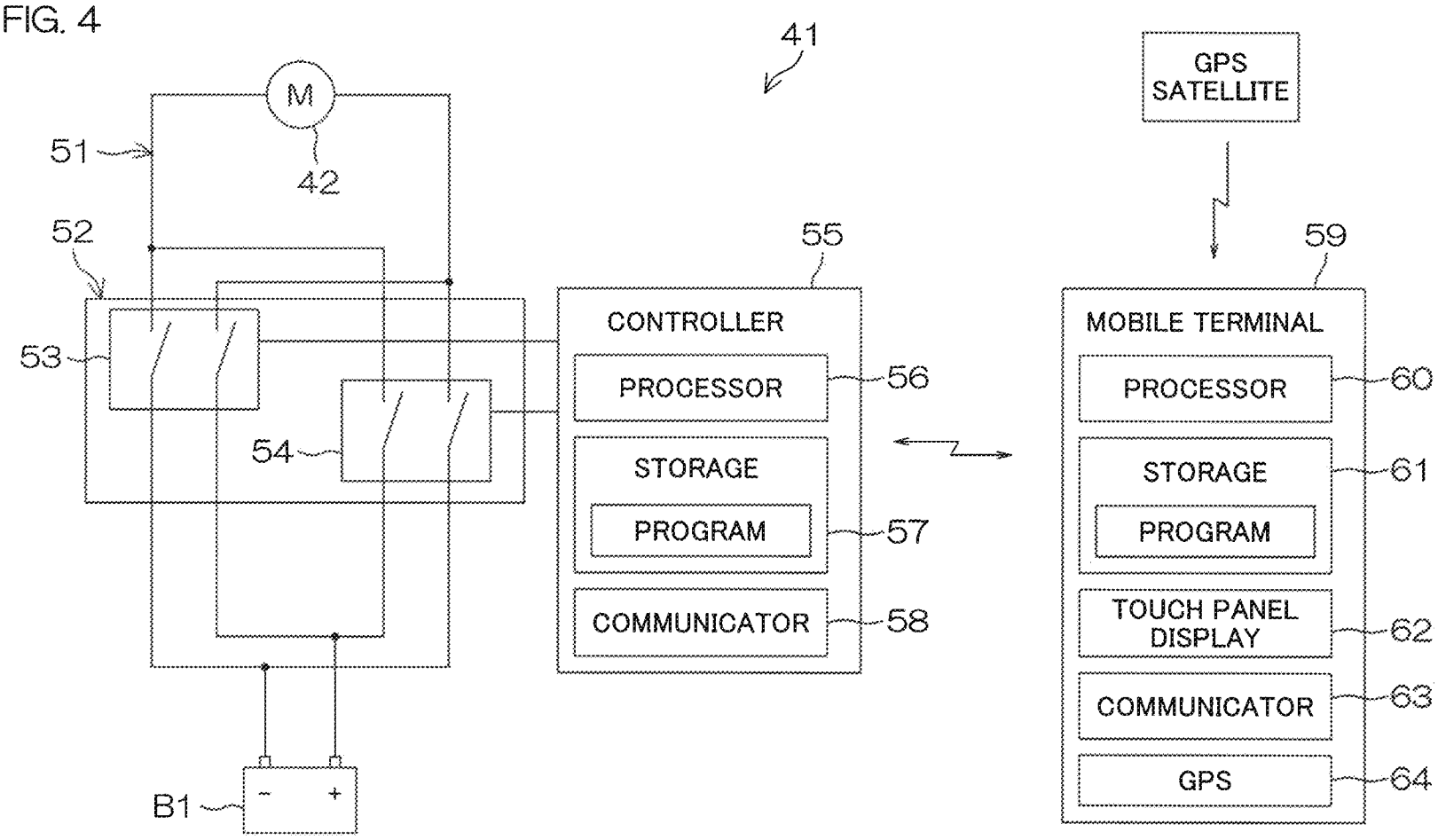
FIG. 4 is a block diagram for describing an electrical configuration of the automatic steering device and a mobile terminal.

FIG. 4 is a block diagram for describing an electrical configuration of the automatic steering device 41 and the mobile terminal 59.

The automatic steering device 41 includes a power supply circuit 51 that supplies electric power of a battery B1 disposed on board to the electric motor 42 and a power supply switch 52 that is switched to an ON-state in which the electric power is supplied from the power supply circuit 51 to the electric motor 42 and an OFF-state in which the electric power supply from the power supply circuit 51 to the electric motor 42 is stopped.

The power supply switch 52 includes a normal rotation switch 53 and a reverse rotation switch 54 disposed on the power supply circuit 51. The normal rotation switch 53 and the reverse rotation switch 54 are both electromagnetic relays. The normal rotation switch 53 and the reverse rotation switch 54 may be provided with switching elements such as transistors, in addition to or in place of the electromagnetic relays.

The normal rotation switch 53 and the reverse rotation switch 54 are both normally off. When a drive signal (normal rotation signal) is transmitted to the normal rotation switch 53, the normal rotation switch 53 is turned on, and electric power is supplied from the power supply circuit 51 to the electric motor 42 via the normal rotation switch 53. The electric motor 42 thus rotates in a normal rotation direction. Similarly, when a drive signal (reverse rotation signal) is transmitted to the reverse rotation switch 54, the reverse rotation switch 54 is turned on, and electric power is supplied from the power supply circuit 51 to the electric motor 42 via the reverse rotation switch 54. The electric motor 42 thus rotates in a reverse rotation direction.

The ON-state of the power supply switch 52 means a state in which one of the normal rotation switch 53 and the reverse rotation switch 54 is on. The OFF-state of the power supply switch 52 means a state in which both of the normal rotation switch 53 and the reverse rotation switch 54 are off. The ON-state of the power supply switch 52 includes a normal rotation state in which the electric motor 42 rotates in the normal rotation direction and a reverse rotation state in which the electric motor 42 rotates in the reverse rotation direction.

The automatic steering device 41 includes an electronic controller 55 that is configured or programmed to control the electric power supply from the power supply circuit 51 to the electric motor 42 by switching the states of the power supply switch 52. The controller 55 sends a drive signal to switch the power supply switch 52 from the OFF-state to the ON-state (normal rotation state or reverse rotation state) to the power supply switch 52. The controller 55, by sending the drive signal, rotates the electric motor 42 in the normal rotation direction or reverse rotation direction at an arbitrary angle.

The controller 55 includes a processor 56 such as a CPU (Central Processing Unit), a storage 57 in which various data including a program is stored, and a communicator 58 that transmits and receives data over a wireless LAN (Local Area Network). The controller 55 is configured or programmed to realize a function as a plurality of function processors such as a motor driver 55*f* to be described below by the processor 56 executing the program stored in the storage 57.

The communicator 58 of the controller 55 is connected via the wireless LAN to the mobile terminal 59 that is operated on board by the vessel operator. The mobile terminal 59 may be a smartphone, or may be a portable computer such as a tablet, for example. Data transmitted from the mobile terminal 59 is received by the communicator 58. Data generated by the controller 55 is transmitted from the communicator 58 and received by the mobile terminal 59.

The mobile terminal 59 includes a processor 60 such as a CPU, a storage 61 in which various data including a program and map data are stored, and a display 62 that is operated by a user and displays various figures and characters. The display 62 is a touch panel display provided with a touch panel being an example of an operated section. The mobile terminal 59 further includes a communicator 63 that transmits and receives data over a wireless LAN and a GPS 64 that receives a signal sent by a GPS (Global Positioning System) satellite and calculates a current position of the mobile terminal 59 based on the signal. The mobile terminal 59 is configured or programmed to realize a function as a plurality of function processors such as a current position calculator 59*a* to be described below by the processor 60 executing the program stored in the storage 61.

The mobile terminal 59 is installed with an autopilot application program to control the course of the vessel 1 so that the vessel 1 is headed to a destination designated by the vessel operator. The mobile terminal 59 generates a destination setting screen to set a destination such as a map screen be displayed on the display 62. Map data may be saved in an external memory such as a memory card, or may be received by the mobile terminal 59 over the Internet. The destination of the vessel 1 is set by the vessel operator operating the display 62 including the touch panel.

Figure 5:
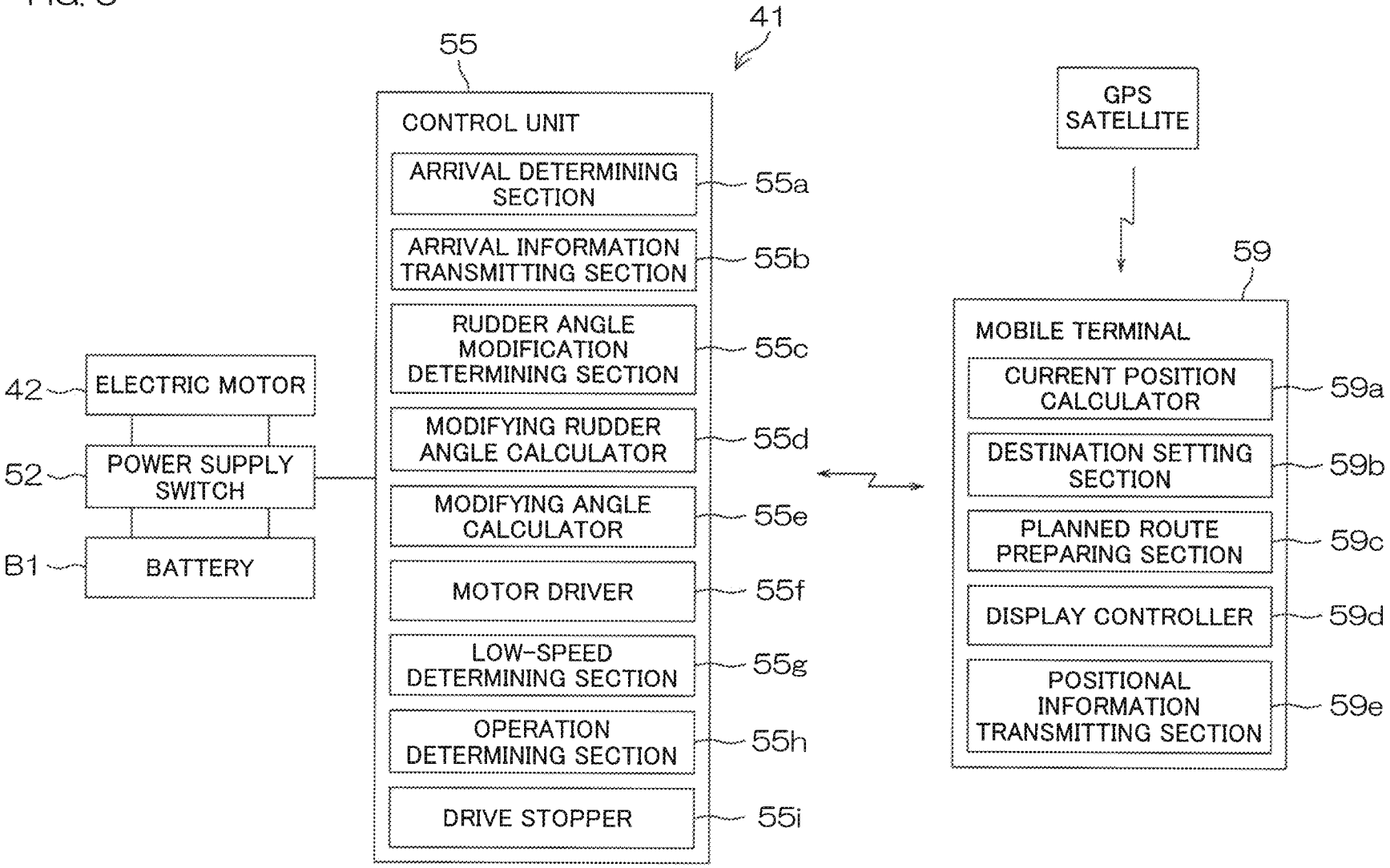
FIG. 5 is a block diagram for describing a functional configuration of the automatic steering device and the mobile terminal.

FIG. 5 is a block diagram for describing a functional configuration of the automatic steering device 41 and the mobile terminal 59.

The mobile terminal 59 is configured or programmed to include a current position calculator 59*a* that calculates a current position of the mobile terminal 59 based on a signal sent by the GPS satellite, a destination setting section 59*b* that sets a position designated by the vessel operator as the destination, and a planned route preparing section 59*c* that prepares a planned route from the current position calculated by the current position calculator 59*a* to the destination set by the destination setting section 59*b*. The mobile terminal 59 further includes a display controller 59*d* that causes the display 62 to display various figures and characters including the current position and map.

The mobile terminal 59 is configured or programmed to include a positional information transmitting section 59*e* that transmits positional information including the current position, destination, and planned route to the controller 55. The positional information is an example of an input signal. The controller 55 is configured or programmed to include an arrival determining section 55*a* that determines whether the vessel 1 has arrived at the destination based on the positional information sent from the mobile terminal 59 and an arrival information transmitting section 55*b* that sends arrival information to inform that the vessel 1 has arrived at the destination to the mobile terminal 59. The controller 55 is configured or programmed to further include a rudder angle modification determining section 55*c* that determines whether modification of a rudder angle is necessary based on the positional information sent from the mobile terminal 59.

The controller 55 is configured or programmed to include a modifying rudder angle calculator 55*d* that calculates a modification amount of the rudder angle if a modification of the rudder angle is necessary and a modifying angle calculator 55*e* that calculates a rotation angle of the electric motor 42 when the rudder turns at the modification amount calculated by the modifying rudder angle calculator 55*d*. The controller 55 is configured or programmed to further include a motor driver 55*f* that controls the electric power supply to the electric motor 42 so that the electric motor 42 rotates at the rotation angle calculated by the modifying angle calculator 55*e*. The motor driver 55*f* is an example of an actuator driver.

Also, the controller 55 is configured or programmed to include a low-speed determining section 55*g* that determines whether a low-speed condition including that the vessel 1 is at low speed holds, an operation determining section 55*h* that determines whether an operation condition including that the vessel operator is operating the steering wheel 32 holds, and a drive stopper 55*i* that makes the motor driver 55*f* stop driving of the electric motor 42 if the operation condition holds when the electric motor 42 is being driven. As to be described below, the motor driver 55*f* drives the electric motor 42 preferably only when the low-speed condition holds.

Figure 6:
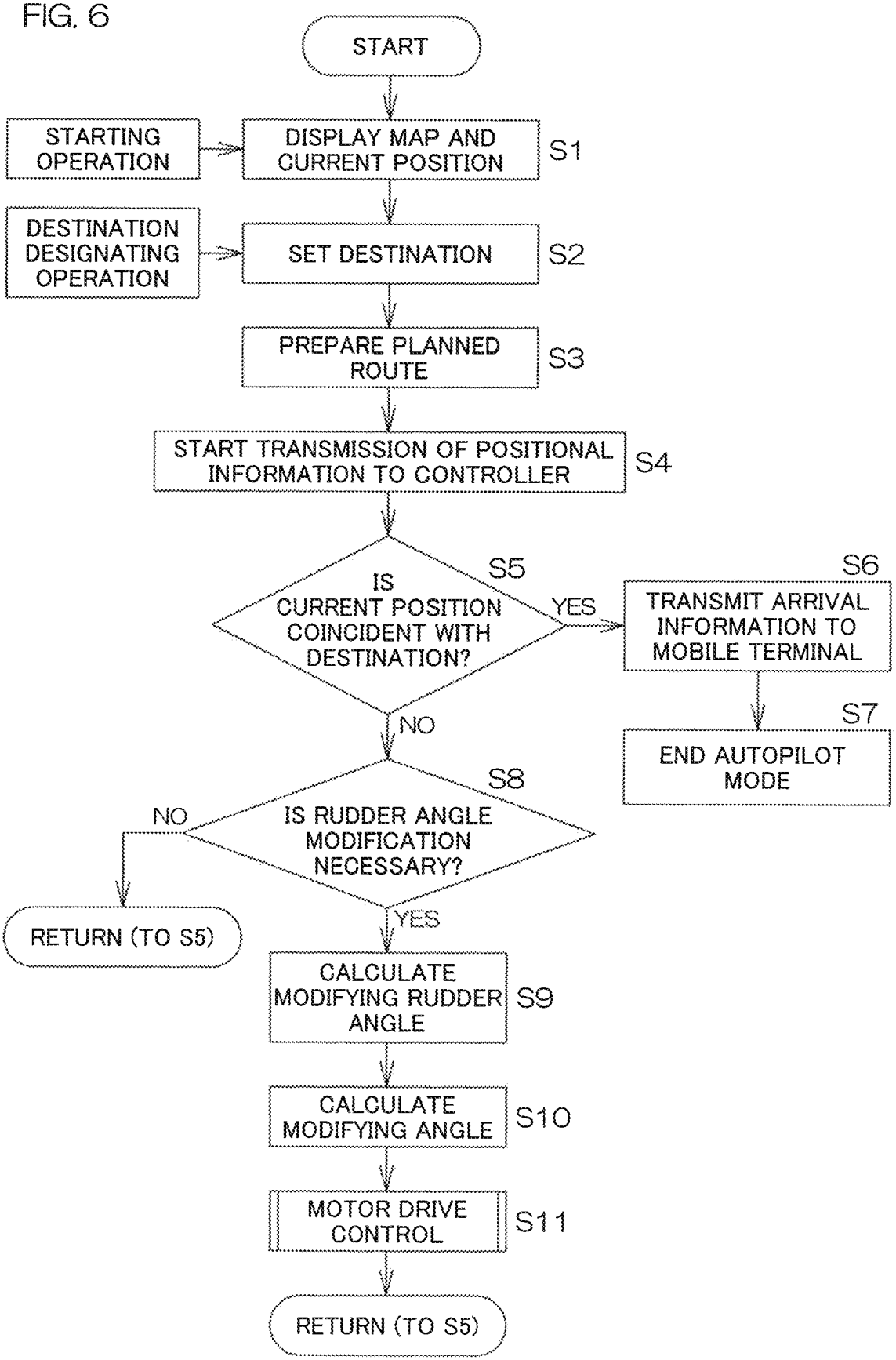
FIG. 6 is a flowchart for describing automatic steering (autopilot).

FIG. 6 is a flowchart for describing automatic steering (autopilot).

When the vessel operator performs a starting operation to start the autopilot application program to the mobile terminal 59, the mobile terminal 59 generates a map including a current position of the mobile terminal 59 equivalent to a current position (origin) of the vessel 1 be displayed on the display 62 to show the current position of the vessel 1 on the map (step S1). When the vessel operator then performs a destination designating operation to designate a destination of the vessel 1 to the mobile terminal 59, the mobile terminal 59 sets the designated position as the destination to start an autopilot mode (step S2). At this time, one or more via points may be designated by the vessel operator. The destination and via points may be designated by the vessel operator touching positions on the map or may be designated by the vessel operator inputting longitudes and latitudes.

After the autopilot mode is started, the mobile terminal 59 prepares a planned route from the current position to the destination to display the same on the map (step S3). Then, the mobile terminal 59 transmits positional information including the current position of the vessel 1 and the destination and planned route of the vessel 1 to the controller 55 (step S4). The positional information is received by the controller 55 to be accumulated. The transmission of the positional information is repeated at regular time intervals until the autopilot mode ends. The mobile terminal 59 updates a display containing a latest current position of the vessel 1 and a planned route from the latest current position to the destination at regular time intervals.

The controller 55, based on the positional information, determines whether the current position of the vessel 1 is coincident with the destination, that is, whether the vessel 1 has arrived at the destination (step S5). If the current position of the vessel 1 is coincident with the destination (if YES in step S5), the controller 55 transmits arrival information to inform that the vessel 1 has arrived at the destination toward the mobile terminal 59 (step S6). After receiving the arrival information, the mobile terminal 59 ends the autopilot mode (step S7).

If the current position of the vessel 1 is not coincident with the destination (if NO in step S5), the controller 55 determines whether a modification of the rudder angle is necessary based on the positional information (step S8). That is, the controller 55 determines whether the vessel 1 is located on the planned route. If the vessel 1 is heading to the destination along the planned route (if NO in step S8), the controller 55 determines a fixed period of time later whether the latest current position of the vessel 1 is coincident with the destination (return to step S5).

If the vessel 1 is off the planned route and is not heading to the destination along the planned route (if YES in step S8), the controller 55 calculates a moving amount (modifying rudder angle) and moving direction of the rudder with which the vessel 1 heads for the destination while returning to the planned route (step S9). At this time, the controller 55 may modify the planned route based on the current position of the vessel 1 and calculate a moving amount (modifying rudder angle) and moving direction of the rudder with which the vessel 1 heads for the destination along the modified planned route. The controller 55 determines a rotation angle (modifying rotation angle) and rotation direction of the electric motor 42 corresponding to the calculation results (step S10).

After the rotation angle (modifying rotation angle) and rotation direction of the electric motor 42 are determined, the controller 55 carries out, if a predetermined condition such that the vessel 1 is at low speed holds, motor drive control that is to rotate the electric motor 42 in a predetermined rotation direction at a predetermined modifying rotation angle (step S11). Then, the controller 55 determines whether the latest current position of the vessel 1 is coincident with the destination (returns to step S5).

Figure 7:
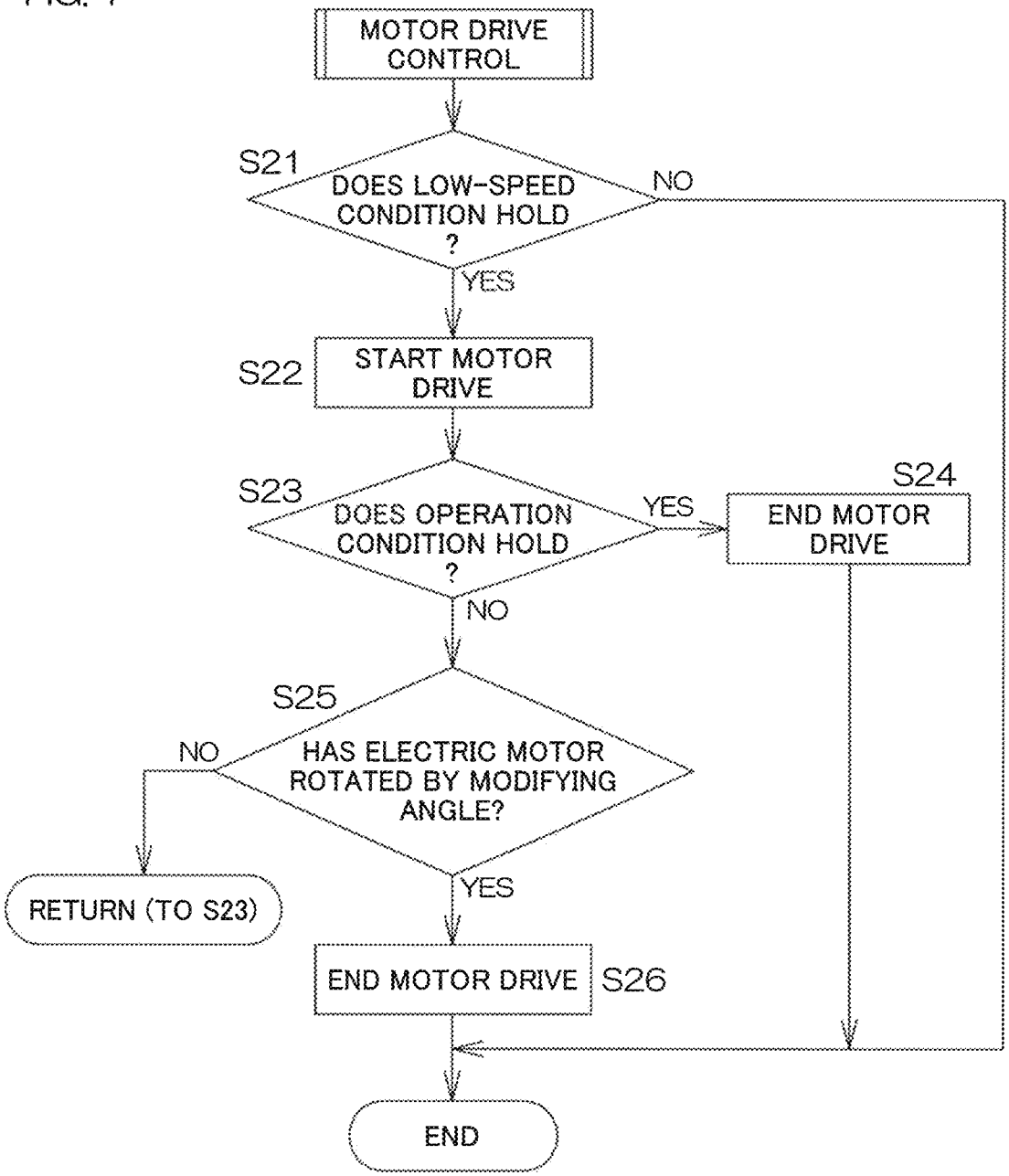
FIG. 7 is a flowchart for describing motor drive control.

FIG. 7 is a flowchart for describing the motor drive control.

The controller 55 determines whether a low-speed condition including that the vessel 1 is at low speed holds (step S21). If the low-speed condition does not hold (if NO in step S21), the controller 55 ends the motor drive control without driving the electric motor 42. If the low-speed condition holds (if YES in step S21), the controller 55 starts an electric power supply to the electric motor 42 so that the electric motor 42 rotates in the rotation direction determined in step S10 of FIG. 6 (step S22).

Specifically, the controller 55 sends a drive signal to switch the power supply switch 52 from the OFF-state to the ON-state (normal rotation state or reverse rotation state) to the power supply switch 52. The power supply switch 52 is thus switched to the ON-state, and electric power is supplied from the power supply circuit 51 to the electric motor 42. Therefore, the electric motor 42 rotates in the normal rotation direction or reverse rotation direction, and the rotation of the electric motor 42 is transmitted to the steering wheel 32 by the transmitting mechanism 43. The rudder of the vessel 1 is turned in the right direction or left direction according to a rotation of the steering wheel 32. The vessel 1 is thus steered in the right direction or left direction.

The controller 55, after the electric power supply to the electric motor 42 is started, determines whether an operation condition including that the vessel operator is operating the steering wheel 32 holds (step S23). If the operation condition holds (if YES in step S23), the controller 55 stops transmitting the drive signal to end the electric power supply to the electric motor 42 (step S24). That is, the controller 55 prioritizes the operation of the steering wheel 32 by the vessel operator to discontinue driving the steering wheel 32 by the electric motor 42.

If the operation condition does not hold (if NO in step S23), the controller 55 determines whether the electric motor 42 has turned by the modifying rotation angle (step S25). The controller 55 may determine whether the electric motor 42 has turned by the modifying rotation angle based on a detection value of a motor rotation angle detector 65 (refer to FIG. 3) that detects a rotation angle of the electric motor 42. Alternatively, the controller 55 may determine whether the electric motor 42 has turned by the modifying rotation angle based on a total of the periods of time for which the drive signal to switch the power supply switch 52 from the OFF-state to the ON-state has been transmitted.

If the electric motor 42 has not turned by the modifying rotation angle (if NO in step S25), the controller 55 monitors whether the operation condition holds while continuing the electric power supply to the electric motor 42 (returns to step S23). If the electric motor 42 has turned by the modifying rotation angle (if YES in step S25), the controller 55 stops transmitting the drive signal to end the electric power supply to the electric motor 42 (step S26). The motor drive control thus ends.

FIG. 8 is a table showing examples of requirements for which the low-speed condition including that the vessel 1 is at low speed holds.

In FIG. 8, "OK" means that the angle etc., of the remote control lever 27 is within a predetermined range, and "NG" means that the angle etc., of the remote control lever 27 is out of a predetermined range.

Regarding the item of the remote control lever 27 in the first line, when the angle of the remote control lever 27 is, for example, within a range over −30 degrees and less than +30 degrees, the controller 55 determines it to be OK, and when the angle of the remote control lever 27 is out of the range, the controller 55 determines it to be NG.

Regarding the item of the rotation speed of the engine 13 in the second line, when the rotation speed of the engine 13 is, for example, less than 1000 rpm, the controller 55 determines it to be OK, and when the rotation speed of the engine 13 is not less than this value, the controller 55 determines it to be NG.

Regarding the item of the speed of the vessel 1 in the third line, when the speed of the vessel 1 is, for example, less than 10 km/h, the controller 55 determines it to be OK, and when the speed of the vessel 1 is not less than this value, the controller 55 determines it to be NG.

The controller 55 determines that the low-speed condition holds if all items are OK, and if at least one item is NG, determines that the low-speed condition does not hold.

The controller 55 is connected to the remote control ECU 30 and the outboard motor ECU 24 via an on-board network such as a CAN (Control Area Network). Various information such as the angle of the remote control lever 27 and the rotation speed of the engine 13 is transmitted to the controller 55 via the on-board network. The outboard motor ECU 24 includes an engine speed detector 66 (refer to FIG. 2) that detects a rotation speed of the engine 13 (crankshaft 14). The speed of the vessel 1 may be calculated based on a detection value of a running speed detector 67 (refer to FIG. 1) provided in the vessel 1, or may be calculated based on a GPS signal.

FIG. 9 is a table showing examples of requirements for which the operation condition including that the vessel operator is operating the steering wheel 32 holds.

In FIG. 9, the driving direction of the steering wheel 32 being right means that a drive command to rotate the steering wheel 32 in the right direction is being provided by the controller 55 to the power supply switch 52. The same applies in the case where the driving direction is left.

The turning speed in FIG. 9 means an amount that an angle of the traveling direction of the vessel 1 has changed per unit of time. For example, when the traveling direction of the vessel 1 has changed from a north direction to a northeast direction in five seconds, the turning speed of the vessel 1 is +45 degrees/5 seconds. An increase in the turning speed of the vessel 1 means that the vessel 1 turns in the right direction, and a decrease in the turning speed of the vessel 1 means that the vessel 1 turns in the left direction. The turning speed may be calculated based on a GPS signal, or may be calculated based on a detection value of a direction detector 91 (refer to FIG. 15) provided in the vessel 1.

When the electric motor 42 is generating a torque to rotate the steering wheel 32 in the right direction, the turning speed of the vessel 1 increases if the vessel operator is not operating the steering wheel 32. On the other hand, in this case, when the vessel operator turns the steering wheel 32 in the left direction, the turning speed of the vessel 1 decreases. Yet, in this case, when the vessel operator keeps the steering wheel 32 at a constant angle, the turning speed of the vessel 1 does not change.

Thus, in the case where the turning speed of the vessel 1 is increasing when the electric motor 42 is generating a torque to rotate the steering wheel 32 in the right direction, the controller 55 determines that the vessel operator is not operating the steering wheel 32. On the other hand, when the turning speed of the vessel 1 is decreasing or does not change, the controller 55 determines that the vessel operator is operating the steering wheel 32.

When the electric motor 42 is generating a torque to rotate the steering wheel 32 in the left direction, the turning speed of the vessel 1 decreases if the vessel operator is not operating the steering wheel 32. In this case, when the turning speed of the vessel 1 is decreasing, the controller 55 determines that the vessel operator is not operating the steering wheel 32. On the other hand, when the turning speed of the vessel 1 is increasing or does not change, the controller 55 determines that the vessel operator is operating the steering wheel 32.

As described above, in the first preferred embodiment, when an input signal that is not based on a rotation of the steering wheel 32 is generated, the power supply switch 52 and the controller 55 being examples of a power supply controller, supply electric power to the electric motor 42. The electric motor 42 is thus rotated, and the rotation is transmitted to the steering wheel 32 by the transmitting mechanism 43 including the driving gear 44 and the driven gear 46. Therefore, even if the vessel operator is not touching the steering wheel 32, the steering wheel 32 rotates.

In the case where the steering mechanism 33 is a mechanical type, the rudder is driven when the steering wheel 32 rotates. In the case where the steering mechanism 33 is an electrical type, when the steering wheel 32 rotates, the rotation is sensed, and a steering motor to turn the rudder is driven. Thus, in either case where the steering mechanism 33 is a mechanical type or an electrical type, the vessel 1 is automatically steered.

In this way, in the present system, an automatic steering function is added by providing the electric motor 42, the transmitting mechanism 43, etc., on the periphery of the steering wheel 32. It is therefore not necessary to greatly modify the existing steering mechanism. Further, a reduction in on-board space is reduced or minimized because of a simple configuration that rotates the steering wheel 32.

Also, in the present preferred embodiment, the electric motor 42 is disposed near the steering wheel 32. That is, the electric motor 42 and the steering wheel 32 are supported by the same console base 5. It is thus prevented that the space other than on the periphery of the steering wheel 32 decreases due to the addition of an automatic steering function.

Also, in the present preferred embodiment, the steering wheel 32 and the console base 5 oppose each other via a space, and the electric motor 42 is disposed in the space. That is, the electric motor 42 is disposed outside of the console base 5 at a position near the steering wheel 32. Further, because the electric motor 42 is disposed outside of the console base 5, the transmitting mechanism 43 is also disposed outside of the console base 5. It is therefore not necessary to secure a space to dispose the electric motor 42 and the transmitting mechanism 43 in an interior of the console base 5.

Also, in the present preferred embodiment, the electric motor 42 and the transmitting mechanism 43 are disposed between the steering wheel 32 and the console base 5, and the waterproof cover 47 covers the electric motor 42 and the transmitting mechanism 43. Therefore, the electric motor 42 and the transmitting mechanism 43 are protected from seawater, rainwater, etc.

Also, in the present preferred embodiment, the driven gear 46 is located near the rotation axis Ah of the steering wheel 32. Further, the driving gear 44 is located near the driven gear 46. The transmitting mechanism 43 is thus downsized. A reduction in on-board space due to the addition of an automatic steering function is reduced or minimized.

Also, in the present preferred embodiment, the rotation of the electric motor 42 is decelerated only one time between the electric motor 42 and the steering wheel 32. When the rotation of the electric motor 42 is decelerated a plurality of times, a plurality of reduction gears are required. Therefore, the transmitting mechanism 43 is increased in size. On the other hand, when the rotation of the electric motor 42 is not decelerated, a motor having a large rated torque, that is, a large-sized motor is required. Therefore, in the present preferred embodiment, an increase in size of the electric motor 42 and the transmitting mechanism 43 is reduced or minimized.

Also, in the present preferred embodiment, the electric motor 42 is coupled at all times to the steering wheel 32. When a power transmission path connecting the electric motor 42 and the steering wheel 32 with each other is disconnected and connected by an electromagnetic clutch, it is necessary to switch the electromagnetic clutch. In contrast, when the electric motor 42 is coupled at all times to the steering wheel 32, such switching control is unnecessary. Thus, the steering system is simplified.

Also, in the present preferred embodiment, because the maximum torque that is transmitted from the electric motor 42 to the steering wheel 32 is small, the operation of the steering wheel 32 by the vessel operator is prioritized over the electric motor 42. Thus, the operation of the steering wheel 32 by the vessel operator is reliably reflected in the steering of the vessel 1. Further, because the maximum torque is small, a small motor is able to be used as the electric motor 42. Therefore, a volume occupied by the electric motor 42 is able to be reduced, so that the electric motor 42 is able to be reduced in power consumption.

Also, in the present preferred embodiment, the electric motor 42 rotates the steering wheel 32 only when the vessel 1 is at low speed. When the vessel 1 is at high speed, because a high water pressure is applied to the rudder, the steering wheel 32 does not move unless a large torque is applied to the steering wheel 32. It is therefore necessary to use a motor having a large rated torque as the electric motor 42. This means that the electric motor 42 is increased in size to increase power consumption. In contrast, limiting it to only a low speed makes it unnecessary to use a motor having a large rated torque as the electric motor 42. Therefore, a volume occupied by the electric motor 42 is reduced, so that the electric motor 42 is reduced in power consumption.

Also, in the present preferred embodiment, it is determined when the electric motor 42 is being driven whether the vessel operator is operating the steering wheel 32. When it is determined that the vessel operator is operating the steering wheel 32, the drive of the electric motor 42 is stopped, and the transmission of torque from the electric motor 42 to the steering wheel 32 is stopped. Therefore his/her steering feeling is prevented from worsening.

Also, in the present preferred embodiment, a command input to the mobile terminal 59 by the vessel operator is received by the communicator 58 of the controller 55 via the wireless LAN, and the controller 55 controls the electric power supply to the electric motor 42 based on the command received by the communicator 58. Because the mobile terminal 59 is not physically connected to the steering system, the vessel operator can provide an instruction to the controller 55 from any place on board. That is, the vessel operator is able to remotely operate the automatic steering device 41. Further, because an operated section and display section necessary for an automatic steering function can be omitted, the console base 5 is able to be simplified.

Second Preferred Embodiment

Next, a second preferred embodiment of the present invention will be described. In the following FIG. 10 to FIG. 13D, elements that are the same or substantially the same as the elements shown in FIG. 1 to FIG. 12 described above are denoted by the same reference symbols as those in FIG. 1 etc., to omit their description.

Figure 10:
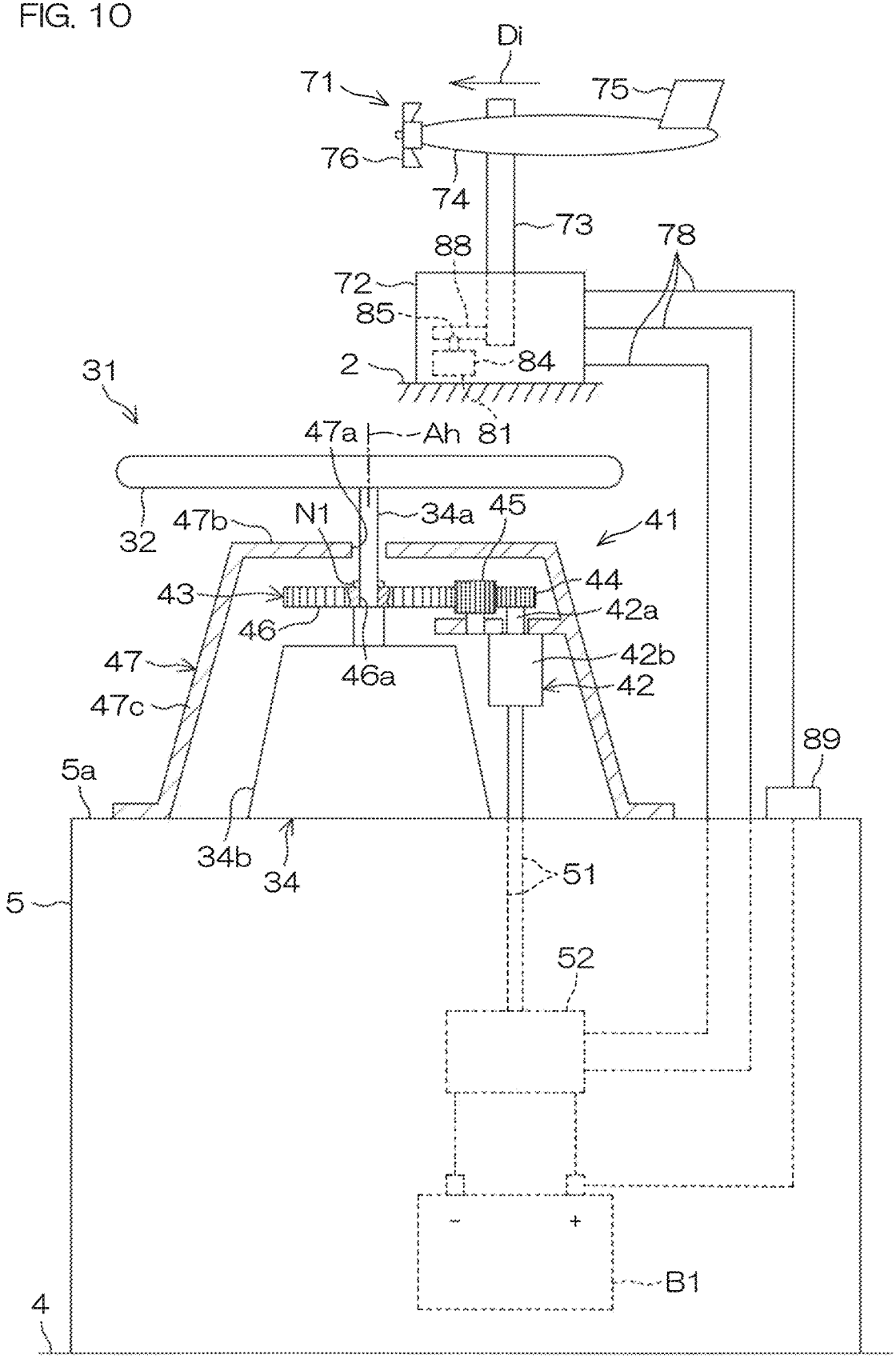
FIG. 10 is a schematic view showing an automatic steering device according to a second preferred embodiment of the present invention.
Figure 11:
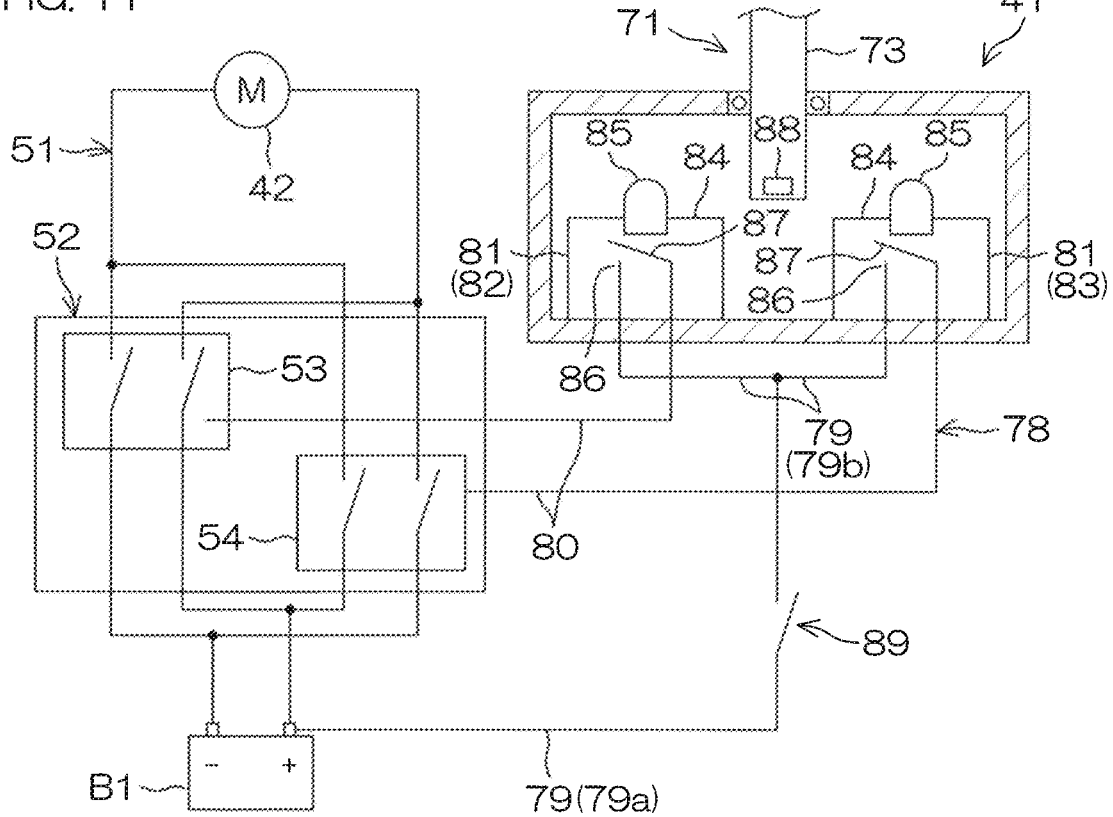
FIG. 11 is a block diagram for describing an electrical configuration of the automatic steering device.
Figure 12:
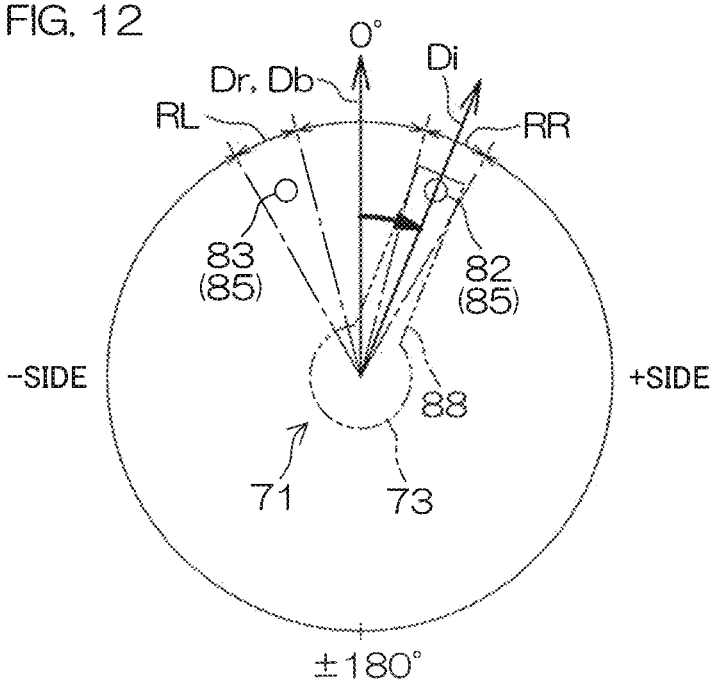
FIG. 12 is a schematic view for describing an angle range in which automatic steering is carried out.

FIG. 10 is a schematic view showing an automatic steering device 41 according to the second preferred embodiment of the present invention. FIG. 11 is a block diagram for describing an electrical configuration of the automatic steering device 41. FIG. 12 is a schematic view for describing an angle range in which automatic steering is carried out.

A major difference between the second preferred embodiment and the first preferred embodiment is that, in place of the mobile terminal 59, a wind direction detector 71 that detects an inclination angle of a bow direction Db (direction from a stern center to a bow) with respect to a wind direction is provided for the automatic steering device 41. The automatic steering device 41 is further provided with, in place of the controller 55, a drive circuit 78 that sends a drive signal to the power supply switch 52 and a drive switch 81 that switches to an ON-state and an OFF-state according to the inclination angle of the bow direction Db with respect to the wind direction. The drive signal that is sent from the drive circuit 78 to the power supply switch 52 is an example of an input signal. The power supply switch 52, the drive circuit 78, and the drive switch 81 are examples of a power supply controller.

As shown in FIG. 10, the wind direction detector 71 includes a base box 72 that is held on the body 2, a rotating shaft 73 that is rotatable and extending upward from the base box 72, a main body 74 that rotates about the rotating shaft 73 with respect to the base box 72 together with the rotation shaft 73, and a wind direction plate 75 that is held on the main body 74 in a vertical posture. The wind direction detector 71 may be a wind speed and direction detector further including a windmill 76 rotatably supported on the distal end of the main body 74. When the main body 74 inclines with respect to the wind direction, the wind direction plate 75 is pushed by wind, and the main body 74 rotates about the rotating shaft 73 together with the wind direction plate 75. The distal end of the main body 74 is thus directed toward the wind.

As shown in FIG. 11, the drive switch 81 includes a normally-open normal rotation drive switch 82 to generate a drive signal to rotate the electric motor 42 in the normal rotation direction and a normally-open reverse rotation drive switch 83 to generate a drive signal to rotate the electric motor 42 in the reverse rotation direction. The drive circuit 78 includes a positive circuit 79 that connects a positive pole of the battery B1 and the normal rotation drive switch 82 and the reverse rotation drive switch 83 and a negative circuit 80 that connects the power supply switch 52 and the normal rotation drive switch 82 and the reverse rotation drive switch 83. The positive circuit 79 includes a main circuit 79*a* connected to the positive pole of the battery B1 and two branching circuits 79*b* that are branching from the main circuit 79*a*.

When the normal rotation drive switch 82 is closed, a drive signal to rotate the electric motor 42 in the normal rotation direction is sent to the normal rotation switch 53, and the normal rotation switch 53 of the power supply switch 52 is switched on. Similarly, when the reverse rotation drive switch 83 is closed, a drive signal to rotate the electric motor 42 in the reverse rotation direction is sent to the reverse rotation switch 54, and the reverse rotation switch 54 of the power supply switch 52 is switched on.

The closed state of the drive switch 81 means a state in which one of the normal rotation drive switch 82 and the reverse rotation drive switch 83 is closed. The open state of the drive switch 81 means a state in which both of the normal rotation drive switch 82 and the reverse rotation drive switch 83 are open. The closed state of the drive switch 81 includes a normal rotation driving state in which the normal rotation drive switch 82 is closed and a reverse rotation driving state in which the reverse rotation drive switch 83 is closed.

The normal rotation drive switch 82 and the reverse rotation drive switch 83 are housed in the base box 72 of the wind direction detector 71. Each of the normal rotation drive switch 82 and the reverse rotation drive switch 83 includes a switch case 84 held in the base box 72, a button 85 that is movable and projecting from the switch case 84, a stationary contact 86 disposed in the switch case 84, and a normally-open movable contact 87 that contacts the stationary contact 86 according to a movement of the button 85. The switch case 84 is non-rotatable with respect to the base box 72. The button 85 is movable in the up-down direction with respect to the switch case 84.

The drive switch 81 includes a rotation portion 88 that closes one of the normal rotation drive switch 82 and the reverse rotation drive switch 83 according to a rotation angle of the wind direction detector 71 (rotating shaft 73). The rotation portion 88 is housed in the base box 72. The rotation portion 88 is projecting horizontally from the rotating shaft 73. The rotation portion 88 extends in an indication direction Di (refer to FIG. 12) of the wind direction detector 71 that is directed toward the wind. The rotation portion 88 is rotatable with respect to the base box 72. The rotation portion 88 is disposed higher than the switch case 84. The rotation portion 88 is disposed at the same height as that of a distal end portion of the button 85 located at an open position. The rotation portion 88 rotates within a horizontal plane. The two buttons 85 are disposed within a range through which the rotation portion 88 passes.

The rotation portion 88 of the drive switch 81 contacts one of the two buttons 85 only when the indication direction Di of the wind direction detector 71 is within an automatic steering range to be described below. When the rotation portion 88 contacts the button 85, the button 85 and the movable contact 87 move to a closed position. The movable contact 87 thus contacts the stationary contacts 86, so that the drive circuit 78 is closed. Therefore, transmission of a drive signal from the drive circuit 78 to the power supply switch 52 is started. Then, when the rotation portion 88 separates from the button 85, the button 85 and the movable contact 87 return to the open position, and the movable contact 87 separates from the stationary contact 86. The drive circuit 78 is thus open, so that the transmission of a drive signal from the drive circuit 78 to the power supply switch 52 is stopped.

As shown in FIG. 12, the wind direction detector 71 is installed in the body 2 so that a reference direction Dr of the wind direction detector 71 is coincident with the bow direction Db. The indication direction Di of the wind direction detector 71 that is directed toward the wind rotates about the rotation shaft 73. When a rotation angle of the indication direction Di falls in a right automatic steering range RR or a left automatic steering range RL, the normal rotation drive switch 82 or the reverse rotation drive switch 83 is closed. The two buttons 85 are disposed in the right automatic steering range RR and the left automatic steering range RL, respectively.

The right automatic steering range RR and the left automatic steering range RL are symmetrical or substantially symmetrical with respect to the reference direction Dr. A rotation angle of the wind direction detector 71 in the reference direction Dr is defined as 0 degrees, a direction clockwise from the reference direction Dr is defined as positive, and a direction counterclockwise from the reference direction Dr is defined as negative. The right automatic steering range RR is, for example, a range of +15 degrees to +30 degrees in rotation angle, and the left automatic steering range RL is a range of −15 degrees to −30 degrees in rotation angle.

As shown in FIG. 11, the automatic steering device 41 includes an ON/OFF switch 89 that opens and closes the drive circuit 78 according to the vessel operator's operation. The ON/OFF switch 89 is disposed in the main circuit 79*a* of the drive circuit 78. The ON/OFF switch 89 may be disposed in the power supply circuit 51. The ON/OFF switch 89 is, for example, installed on the console base 5 (refer to FIG. 10).

The ON/OFF switch 89 is a manual switch that is operated by the vessel operator. When the ON/OFF switch 89 is on, even if either of the normal rotation drive switch 82 and the reverse rotation drive switch 83 is closed, a drive signal is transmitted from the drive circuit 78 to the power supply switch 52. On the other hand, when the ON/OFF switch 89 is off, if either of the normal rotation drive switch 82 and the reverse rotation drive switch 83 is closed, because the drive circuit 78 is disconnected at the position of the ON/OFF switch 89, no drive signal is generated. Thus, the vessel operator is able to switch executing an automatic steering mode and stopping the execution by operating the ON/OFF switch 89.

FIG. 13A to FIG. 13D are schematic views for describing motions when the vessel 1 is automatically steered.

Figures 13A, 13B, 13C, 13D:
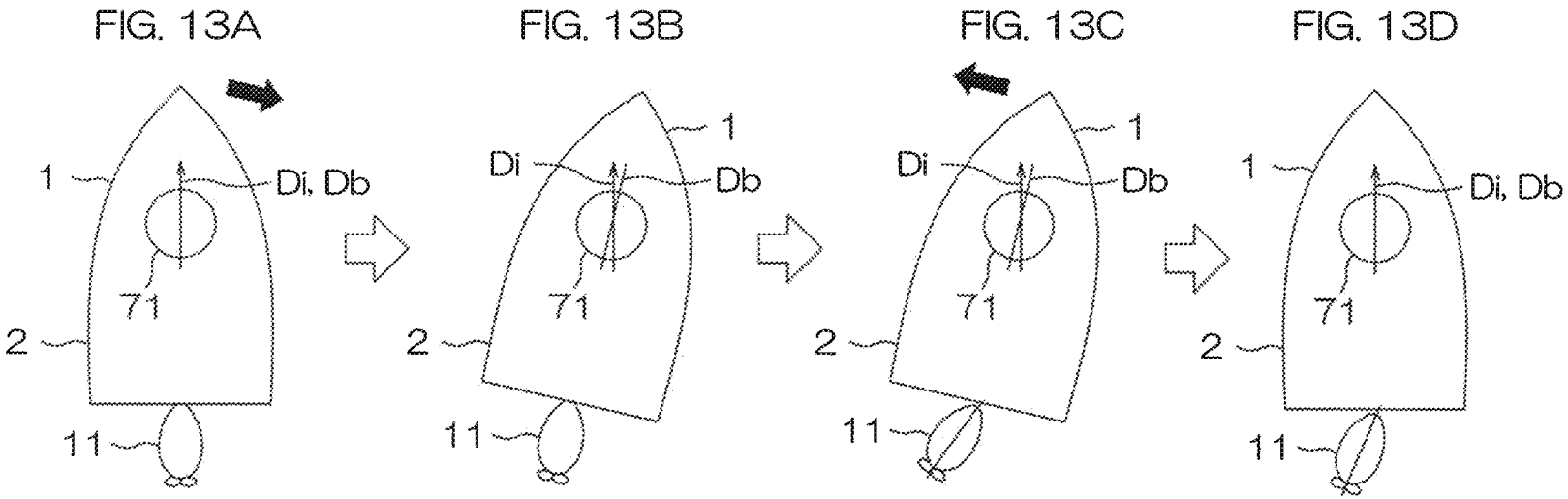
FIG. 13A, FIG. 13B, FIG. 13C, and FIG. 13D are schematic views for describing motions when the vessel is automatically steered.

FIG. 13A shows a state in which the bow is directed toward the wind. In this state, the indication direction Di of the wind direction detector 71 is almost coincident with the bow direction Db, and the indication direction Di has an inclination angle of almost 0 degrees with respect to the bow direction Db.

As shown FIG. 13B, when the vessel 1 rotates clockwise or counterclockwise under the influence of wind, a current, etc., the wind direction detector 71 rotates so that the indication direction Di is toward the wind. Therefore, the inclination angle of the indication direction Di with respect to the bow direction Db changes.

When an absolute value of the inclination angle of the indication direction Di reaches a predetermined value, that is, when the rotation angle of the indication direction Di falls in the right automatic steering range RR or the left automatic steering range RL, the normal rotation drive switch 82 or the reverse rotation drive switch 83 is closed. A drive signal is thus transmitted from the drive circuit 78 to the power supply switch 52, and the power supply switch 52 is closed. As a result, the electric motor 42 is driven.

As shown in FIG. 13C, when the electric motor 42 is driven, the outboard motor 11 equivalent to the rudder of the vessel 1 is turned. The vessel 1 is propelled in this state. Therefore, as shown in FIG. 13D, the vessel 1 turns so that the bow is directed toward the wind. The inclination angle of the indication direction Di with respect to the bow direction Db is thus reduced, and the drive of the electric motor 42 is stopped.

As described above, in the second preferred embodiment, when the inclination angle of the bow direction Db with respect to the wind direction becomes a predetermined value, the drive switch 81 turns on, and an input signal (drive signal) that is not based on a rotation of the steering wheel 32 is transmitted from the drive circuit 78 to the power supply switch 52. The electric power of the battery B1 is thus supplied from the power supply circuit 51 to the electric motor 42, and the electric motor 42 is driven. Therefore, the bow is automatically directed toward the wind. Thus, even if the vessel operator does not operate the steering wheel 32, the bow is automatically directed toward the wind.

Also, in the present preferred embodiment, the ON/OFF switch 89 is turned on/off by the vessel operator. Where the ON/OFF switch 89 is provided in the drive circuit 78, the drive circuit 78 is open when the ON/OFF switch 89 is off, so that no input signal is generated. Where the ON/OFF switch 89 is provided in the power supply circuit 51, the power supply circuit 51 is open when the ON/OFF switch 89 is off, so that the supply of electric power from the power supply circuit 51 to the electric motor 42 is shut off. Therefore, the vessel operator is able to validate and invalidate the automatic steering function by operating the ON/OFF switch 89.

Third Preferred Embodiment

Next, a third preferred embodiment of the present invention will be described. In the following FIG. 14, elements that are the same or substantially the same as the elements shown in FIG. 1 to FIG. 13D described above are denoted by the same reference symbols as those in FIG. 1 etc., to omit their description.

Figure 14:
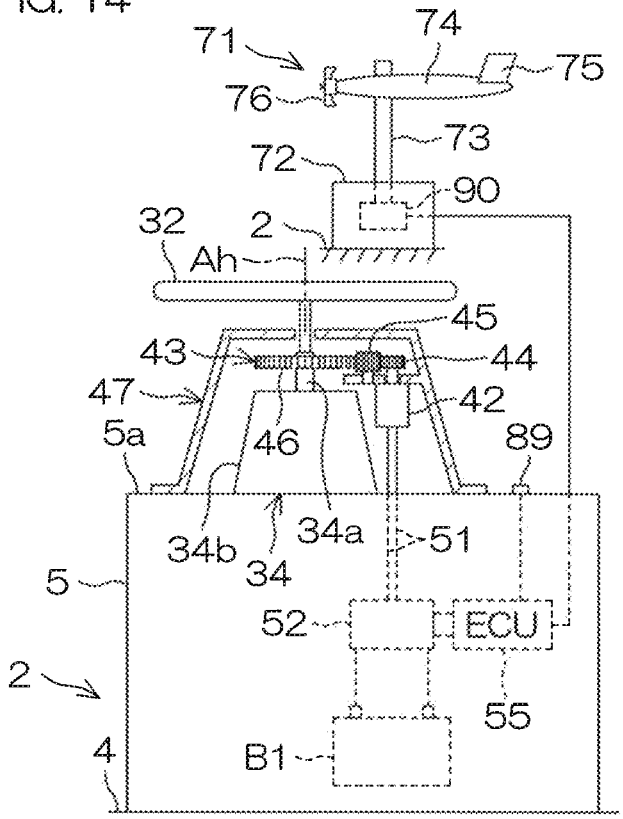
FIG. 14 is a schematic view showing an automatic steering device according to a third preferred embodiment of the present invention.

FIG. 14 is a schematic view showing an automatic steering device 41 according to a third preferred embodiment of the present invention.

A major difference between the third preferred embodiment and the second preferred embodiment is that, in place of the drive circuit 78 and the drive switch 81, a wind direction rotation angle detector 90 that detects a rotation angle of the wind direction detector 71 (rotation angle of the indication direction Di) and a controller 55 that determines an inclination angle of the bow direction Db with respect to the wind direction based on the detection value of the wind direction rotation angle detector 90 are provided in the automatic steering device 41. An angle signal that is transmitted from the wind direction rotation angle detector 90 of the wind direction detector 71 to the controller 55 is an example of an input signal.

The wind direction rotation angle detector 90 is housed in the base box 72. The wind direction rotation angle detector 90 includes any of, for example, a potentiometer, a rotary encoder, and a magnetic sensor. The wind direction rotation angle detector 90 outputs a detection value that is directly proportional to a clockwise angle (refer to FIG. 12) from the reference direction Dr to the indication direction Di.

Figure 16:
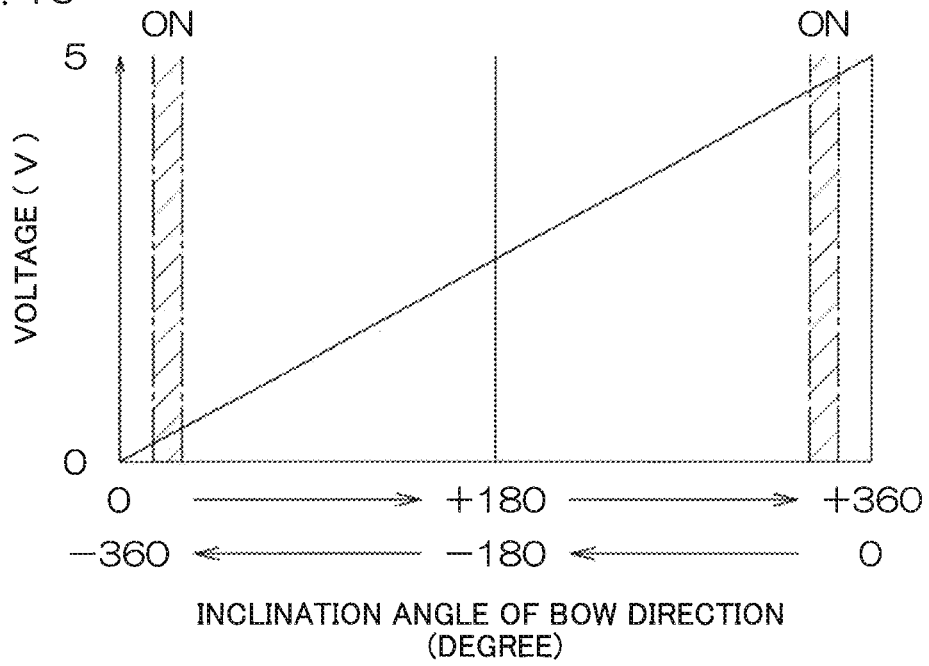
FIG. 16 is a graph showing the relationship of an inclination angle of a bow direction and an output voltage of a detector that detects the inclination angle.

FIG. 16 shows an example in which the detection value (output voltage) of the wind direction rotation angle detector 90 changes in a range of 0 V to 5 V. The output voltage when the indication direction Di is coincident with the reference direction Dr is 0 V, and the output voltage when the indication direction Di has rotated 360 degrees clockwise is 5 V.

A rotation angle of the indication direction Di in the reference direction Dr is defined as 0 degrees, a direction clockwise from the reference direction Dr is defined as positive, and a direction counterclockwise from the reference direction Dr is defined as negative. A range where the output voltage of the wind direction rotation angle detector 90 is 0.5 V to 1.0 V is a right automatic steering range RR of +15 degrees to +30 degrees as a rotation angle of the indication direction Di, for example. A range where the output voltage of the wind direction rotation angle detector 90 is 4.0 V to 4.5 V is a left automatic steering range RL of −15 degrees to −30 degrees as a rotation angle of the indication direction Di, for example.

The controller 55 is connected to the wind direction rotation angle detector 90 and the power supply switch 52. The controller 55 determines an inclination angle of the bow direction Db with respect to the wind direction based on a magnitude of the detection value (output voltage) of the wind direction rotation angle detector 90. Similar to the second preferred embodiment, the controller 55, when the rotation angle of the indication direction Di falls in the right automatic steering range RR or the left automatic steering range RL, sends a drive signal to the power supply switch 52 to supply electric power from the power supply circuit 51 to the electric motor 42. The electric motor 42 thus rotates, and the rudder is driven so that the bow direction Db approaches the indication direction Di.

The automatic steering device 41 further includes an ON/OFF switch 89 that is operated by the vessel operator to switch executing an automatic steering mode and stopping the execution. The ON/OFF switch 89 is installed on the console base 5. The ON/OFF switch 89 is connected to the controller 55. The controller 55 turns on or off the automatic steering mode according to an operation of the ON/OFF switch 89 by the vessel operator.

When the automatic steering mode is on, the controller 55, as described above, sends a drive signal to the power supply switch 52 according to an inclination angle of the bow direction Db with respect to the wind direction. In contrast, when the automatic steering mode is off, the controller 55 does not send a drive signal to the power supply switch 52. Thus, the vessel operator is able to switch executing an automatic steering mode and stopping the execution by operating the ON/OFF switch 89.

As described above, in the third preferred embodiment, the wind direction detector 71 generates an input signal (angle signal) indicating an inclination angle of the bow direction Db with respect to the wind direction. The controller 55 supplies electric power to the electric motor 42 according to the input signal generated by the wind direction detector 71. The bow is thus automatically directed toward the wind. Thus, even if the vessel operator does not operate the steering wheel 32, the bow is automatically directed toward the wind.

Fourth Preferred Embodiment

Next, a fourth preferred embodiment of the present invention will be described. In the following FIG. 15, elements that are the same or substantially the same as the elements shown in FIG. 1 to FIG. 14 described above are denoted by the same reference symbols as those in FIG. 1 etc., to omit their description.

Figure 15:
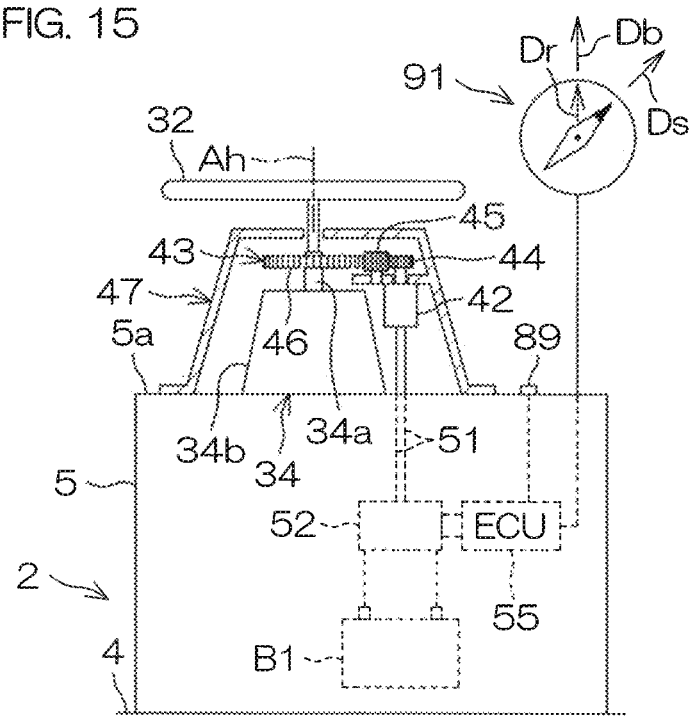
FIG. 15 is a schematic view showing an automatic steering device according to a fourth preferred embodiment of the present invention.

FIG. 15 is a schematic view showing an automatic steering device 41 according to a fourth preferred embodiment of the present invention.

A major difference between the fourth preferred embodiment and the third preferred embodiment is that, in place of the wind direction detector 71 and the wind direction rotation angle detector 90, a direction detector 91 that detects an inclination angle of the bow direction Db with respect to a horizontal setting direction Ds that is set by the vessel operator is provided in the automatic steering device 41. An angle signal that is transmitted from the direction detector 91 to the controller 55 is an example of an input signal. Specific examples of the direction detector 91 are a gyrocompass provided with a gyroscope, a GPS compass provided with a plurality of GVS receivers to receive GPS signals, and an electronic compass provided with a plurality of magnetic sensors such as hall elements.

The direction detector 91 is held in the body 2 so that a reference direction Dr of the direction detector 91 is coincident with the bow direction Db. The direction detector 91 may be installed on the console base 5. The direction detector 91 outputs a detection value that is directly proportional to a clockwise angle from the reference direction Dr to the setting direction Ds. The setting direction Ds is an arbitrary horizontal direction (e.g., a north direction), and set by the vessel operator. When the bow direction Db changes, the reference direction Dr and the setting direction Ds relatively rotate about a vertical line, and an inclination angle of the setting direction Ds with respect to the reference direction Dr changes.

The detection value (output voltage) of the direction detector 91 changes in a range of, for example, 0 V to 5 V (refer to FIG. 16). A rotation angle of the setting direction Ds in the reference direction Dr is defined as 0 degrees, a direction clockwise from the reference direction Dr is defined as positive, and a direction counterclockwise from the reference direction Dr is defined as negative. A range where the output voltage of the direction detector 91 is 0.5 V to 1.0 V is a right automatic steering range RR of +15 degrees to +30 degrees as a rotation angle of the setting direction Ds, for example. A range where the output voltage of the direction detector 91 is 4.0 V to 4.5 V is a left automatic steering range RL of −15 degrees to −30 degrees as a rotation angle of the setting direction Ds, for example.

The controller 55 is connected to the direction detector 91 and the power supply switch 52. The controller 55 determines an inclination angle of the bow direction Db with respect to the setting direction Ds based on a magnitude of the detection value (output voltage) of the direction detector 91. Similar to the second preferred embodiment, the controller 55, when the rotation angle of the setting direction Ds falls in the right automatic steering range RR or the left automatic steering range RL, sends a drive signal to the power supply switch 52 to supply electric power from the power supply circuit 51 to the electric motor 42. The electric motor 42 thus rotates, and the rudder is driven so that the bow direction Db approaches the setting direction Ds.

As described above, in the fourth preferred embodiment, the direction detector 91 generates an input signal (angle signal) indicating an inclination angle of the bow direction Db with respect to a magnetic field direction. The controller 55 supplies electric power to the electric motor 42 according to the input signal generated by the direction detector 91. The bow is thus automatically directed toward a preset direction. Thus, even if the vessel operator does not operate the steering wheel 32, a state where the bow is directed toward the specific direction is maintained.

Fifth Preferred Embodiment

Next, a fifth preferred embodiment of the present invention will be described. In the following FIG. 17, elements that are the same or substantially the same as the elements shown in FIG. 1 to FIG. 16 described above are denoted by the same reference symbols as those in FIG. 1 etc., to omit their description.

Figure 17:
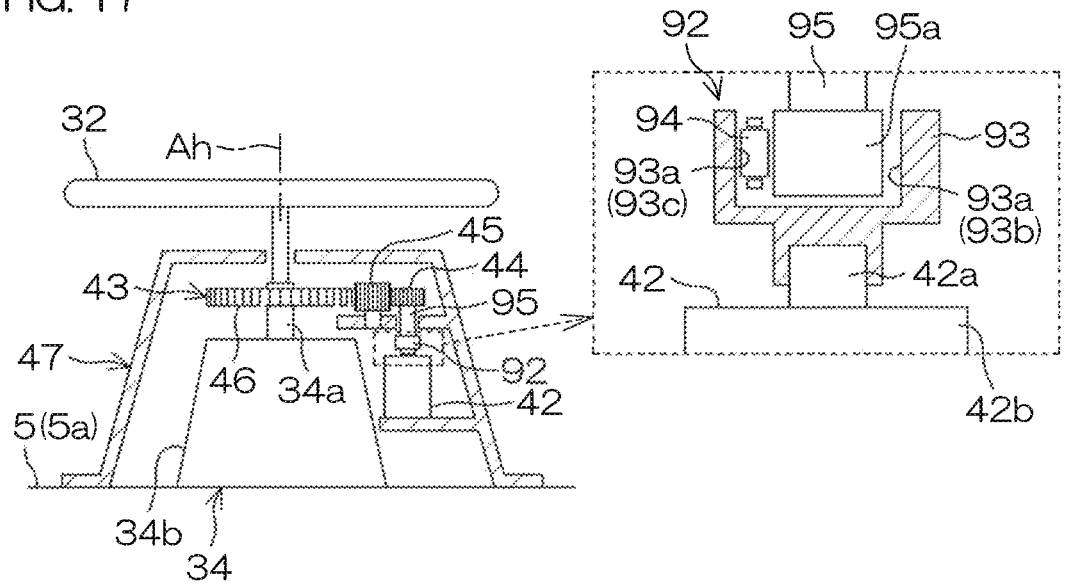
FIG. 17 is a schematic view showing an automatic steering device according to a fifth preferred embodiment of the present invention.

FIG. 17 is a schematic view showing an automatic steering device 41 according to a fifth preferred embodiment of the present invention.

A major difference between the fifth preferred embodiment and the first preferred embodiment is that the transmitting mechanism 43 further includes a reverse input shutoff clutch 92 that disconnects a power transmission path connecting the electric motor 42 and the steering wheel 32 when the steering wheel 32 is operated.

The reverse input shutoff clutch 92 transmits torque in the normal rotation direction and the reverse rotation direction from the side of the electric motor 42 to the side of the steering wheel 32. On the other hand, the reverse input shutoff clutch 92, when torque is input from the side of the steering wheel 32 to the reverse input shutoff clutch 92, disconnects the transmission path by making the reverse input shutoff clutch 92 (an output member 95 to be described below) slip. The reverse input shutoff clutch 92 is disclosed in, for example, JP 2003-56603 A. The entire disclosure of this publication is incorporated herein by reference.

The motor shaft 42*a* of the electric motor 42 is coupled to the driving gear 44 via the reverse input shutoff clutch 92. The reverse input shutoff clutch 92 includes an input member 93 that rotates together with the motor shaft 42*a*, an output member 95 that rotates together with the driving gear 44, and a plurality of cylindrical rollers 94 located between the input member 93 and the output member 95. An inner peripheral surface 93*a* of the input member 93 surrounds a circular cylindrical outer peripheral surface 95*a* of the output member 95 via the plurality of cylindrical rollers 94. The inner peripheral surface 93*a* of the input member 93 has a structure in which a locking surface 93*b* and an unlocking surface 93*c* are circumferentially arranged. A radial distance from the locking surface 93*b* to the outer peripheral surface 95*a* of the output member 95 is smaller than a diameter of the cylindrical roller 94 and a radial distance from the unlocking surface 93*c* to the outer peripheral surface 95*a* of the output member 95 is larger than the diameter of the cylindrical roller 94.

When the electric motor 42 begins to rotate, the input member 93 rotates with respect to the output member 95, and the cylindrical roller 94 is caught in the gap between the locking surface 93*b* and the outer peripheral surface 95*a* of the output member 95. The output member 95 is thus locked by the input member 93, so that torque is transmitted from the input member 93 to the output member 95 via the plurality of cylindrical rollers 94. The torque of the electric motor 42 is thus transmitted to the driving gear 44 via the reverse input shutoff clutch 92.

On the other hand, when the vessel operator rotates the steering wheel 32, the rotation of the steering wheel 32 is transmitted to the output member 95, and the output member 95 rotates with respect to the input member 93. Because the outer peripheral surface 95*a* of the output member 95 is in a circular cylindrical shape, the cylindrical roller 94 is, at this time, not caught in the gap between the locking surface 93*b* and the outer peripheral surface 95*a* of the output member 95 but stays between the unlocking surface 93*c* and the outer peripheral surface 95*a* of the output member 95. Therefore, the output member 95 slips, and the transmission of torque from the output member 95 to the input member 93 is shut off.

As described above, in the fifth preferred embodiment, torque in the normal rotation direction and in the reverse rotation direction is transmitted from the electric motor 42 to the steering wheel 32 via the reverse input shutoff clutch 92. On the other hand, when the vessel operator applies torque in the normal rotation direction and the reverse rotation direction to the steering wheel 32, the reverse input shutoff clutch 92 disconnects the transmission path. Therefore, when the vessel operator operates the steering wheel 32, no inertial resistance or electrical braking force of the electric motor 42 is transmitted to the vessel operator via the steering wheel 32. Therefore his/her steering feeling is prevented from worsening.

Other Preferred Embodiments

Although the preferred embodiments of the present invention have been described above, the present invention is not restricted to the contents of the preferred embodiments and various modifications are possible within the scope of the present invention.

For example, in the preferred embodiment described above, the number of outboard motors 11 preferably is one, for example. However, the number of outboard motors 11 may be two or three. Also, the vessel propulsion apparatus 6 may include an inboard motor or an inboard/outboard motor or may include a jet propulsion device, in place of the outboard motor 11.

In the preferred embodiments described above, the steering mechanism 33 preferably is a hydraulic type. However, the helm pump 34 and the hydraulic cylinder 36 may be omitted from the steering mechanism 33.

For example, the steering mechanism 33 may be a cable type provided with a push-pull cable that transmits motion of the steering wheel 32 to the rudder. Alternatively, the steering mechanism 33 may be an electrical type provided with a steering wheel operation detector 68 (refer to FIG. 1) that detects motion of the steering wheel 32, a steering motor that generates power to turn the rudder, and a steering ECU that controls the steering motor based on the detection value of the steering wheel operation detector 68.

In the preferred embodiments described above, the shift mechanism to shift the dog clutch 16*b* preferably is an electrical type provided with the shift actuator 22, and the throttle mechanism to change the opening degree of the throttle valve is an electrical type provided with the throttle actuator 23. However, the shift mechanism may be a mechanical type (hydraulic type or cable type) provided with no shift actuator 22. Similarly, the throttle mechanism may be a mechanical type provided with no throttle actuator 23.

In the preferred embodiments described above, the electric motor 42 preferably is disposed between the console base 5 and the steering wheel 32, and is supported by the console base 5. However, the electric motor 42 may be disposed in a position other than between the console base 5 and the steering wheel 32. For example, the electric motor 42 and the transmitting mechanism 43 may be disposed in the console base 5. The electric motor 42 may be supported by another member such as the deck 4 or the body 3.

In the preferred embodiments described above, the transmitting mechanism 43 preferably decelerates the rotation of the electric motor 42 only one time between the electric motor 42 and the steering wheel 32. However, the transmitting mechanism 43 may decelerate the rotation of the electric motor 42 a plurality of times. Or, the electric motor 42 may be a motor that is coaxial with the rotation axis Ah of the steering wheel 32. In this case, the steering wheel 32 is driven to rotate in the same direction at the same speed and at the same angle as those of the electric motor 42.

In the preferred embodiments described above, the driving gear 44 and the driven gear 46 preferably have rotation axes that are parallel or substantially parallel to each other. However, the driving gear 44 and the driven gear 46 may not have rotation axes that are parallel or substantially parallel to each other. The driven gear 46 may be a worm wheel that is coaxial with the steering wheel 32 and the driving gear 44 may be a worm that is engaged with the worm wheel.

In the preferred embodiments described above, the driven gear 46 preferably is coupled to the pump shaft 34*a* equivalent to a steering shaft. However, the driven gear 46 may be coupled to a member located on the rotation axis Ah of the steering wheel 32 other than the pump shaft 34*a*. Also, the driven gear 46 may be coupled to the steering wheel 32.

In the preferred embodiments described above, the controller 55 preferably determines whether modification of the rudder angle is necessary, and calculates a modification amount of the rudder angle if a modification of the rudder angle is necessary. However, the mobile terminal 59 may perform up to the calculation of a modification amount of the rudder angle (up to step S9 of FIG. 6), and transmit the modification amount of the rudder angle to the controller 55.

In the preferred embodiments described above, the controller 55 preferably supplies electric power to the electric motor 42 only when the low-speed condition holds. However, when a modification of the rudder angle is necessary, the controller 55 may supply electric power to the electric motor 42 regardless of the speed of the vessel 1.

In the preferred embodiments described above, the controller 55 preferably determines whether the vessel operator is operating the steering wheel 32 based on the behavior of the vessel 1 and the direction in which the electric motor 42 rotates the steering wheel 32. However, when the vessel 1 is provided with the steering wheel operation detector 68 (refer to FIG. 1) that detects motion of the steering wheel 32, the controller 55 may determine whether the vessel operator is operating the steering wheel 32 based on the direction in which the electric motor 42 rotates the steering wheel 32 and the moving direction and speed of the steering wheel 32.

Also, features of two or more of the various preferred embodiments described above may be combined.

The present application claims priority to Japanese Patent Application No. 2015-093294 filed on Apr. 30, 2015 in the Japan Patent Office, and the entire disclosure of this application is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A steering system for a vessel, the steering system comprising:

an electric actuator that generates power to rotate a steering wheel;

a transmitting mechanism including a driving member that rotates together with an output portion of the electric actuator and a driven member that rotates together with the steering wheel, the transmitting mechanism transmits a rotation of the output portion of the electric actuator to the steering wheel; and a power supply controller that causes the electric actuator to rotate the steering wheel according to an input signal that is not based on a rotation of the steering wheel when a speed of the vessel is less than 10 km/h.

2. The steering system for a vessel according to claim 1, wherein the vessel includes a console base that rotatably supports the steering wheel; and the electric actuator is supported by the console base.

3. The steering system for a vessel according to claim 2, wherein the electric actuator is disposed between the console base and the steering wheel.

4. The steering system for a vessel according to claim 3, further comprising a cover that covers both the electric actuator and transmitting mechanism.

5. The steering system for a vessel according to claim 1, wherein the driven member is located on a rotation axis of the steering wheel; and the driving member is located around the driven member.

6. The steering system for a vessel according to claim 1, wherein the transmitting mechanism decelerates the rotation of the electric actuator between the electric actuator and the steering wheel only one time.

7. The steering system for a vessel according to claim 1, wherein the transmitting mechanism couples the electric actuator to the steering wheel at all times.

8. The steering system for a vessel according to claim 1, wherein the transmitting mechanism further includes a clutch that transmits the power of the electric actuator toward the steering wheel on a power transmission path connecting the electric actuator and the steering wheel with each other and disconnects the transmission path when a vessel operator applies torque to the steering wheel.

9. The steering system for a vessel according to claim 1, wherein the power supply controller causes the electric actuator to rotate the steering wheel only when an engine that generates power to propel the vessel is at a rotation speed of about 1000 rpm or less.

10. The steering system for a vessel according to claim 1, wherein the power supply controller includes a controller, and the controller is configured or programmed to include:

a modifying angle calculator that calculates a rotation angle of the electric actuator according to the input signal; and an actuator driver that controls an electric power supply to the electric actuator such that the electric actuator rotates at the rotation angle calculated by the modifying angle calculator.

11. The steering system for a vessel according to claim 10, wherein the controller further includes a communicator that is connected via a wireless communication network to a mobile terminal to be operated by a vessel operator and receives the input signal sent from the mobile terminal.

12. The steering system for a vessel according to claim 11, wherein the mobile terminal includes an operated section that is operated when a vessel operator designates a destination of the vessel; and the power supply controller controls a course of the vessel such that the vessel is headed to the destination designated by the mobile terminal by controlling the electric power supply to the electric actuator.

13. The steering system for a vessel according to claim 12, wherein the mobile terminal further includes a GPS that calculates a current position of the mobile terminal based on a signal sent by a GPS satellite.

14. The steering system for a vessel according to claim 1, further comprising a wind direction detector that detects an inclination angle of a bow direction with respect to a wind direction to generate the input signal.

15. The steering system for a vessel according to claim 1, further comprising:

a power supply circuit that connects the electric actuator to a battery; and a wind direction detector that detects an inclination angle of a bow direction with respect to a wind direction; wherein the power supply controller includes:

a power supply switch that controls an electric power supply from the power supply circuit to the electric actuator;

a drive circuit that transmits to the power supply switch the input signal to supply electric power from the power supply circuit to the electric actuator; and a drive switch that switches to an ON-state to generate the input signal and an OFF-state to open the drive circuit according to the inclination angle of the bow direction with respect to the wind direction detected by the wind direction detector.

16. The steering system for a vessel according to claim 15, further comprising an ON/OFF switch that opens and closes one of the power supply circuit and drive circuit according to a vessel operator's operation.

17. A steering system for a vessel, the steering system comprising:

an electric actuator that generates power to rotate a steering wheel;

a transmitting mechanism including a driving member that rotates together with an output portion of the electric actuator and a driven member that rotates together with the steering wheel, the transmitting mechanism transmits a rotation of the output portion of the electric actuator to the steering wheel; and a power supply controller that causes the electric actuator to rotate the steering wheel according to an input signal that is not based on a rotation of the steering wheel; wherein the power supply controller includes a controller, and the controller is configured or programmed to include:

an actuator driver that controls an electric power supply to the electric actuator;

an operation detector that determines whether an operation condition including that a vessel operator is operating the steering wheel holds; and a drive stopper that causes the actuator driver to stop drive of the electric actuator if the operation condition holds when the electric actuator is being driven.

18. A steering system for a vessel, the steering system comprising:

an electric actuator that generates power to rotate a steering wheel;

a transmitting mechanism including a driving member that rotates together with an output portion of the electric actuator and a driven member that rotates together with the steering wheel, the transmitting mechanism transmits a rotation of the output portion of the electric actuator to the steering wheel;

a power supply controller that causes the electric actuator to rotate the steering wheel according to an input signal that is not based on a rotation of the steering wheel; and a direction detector that detects an inclination angle of a bow direction with respect to a magnetic field direction to generate the input signal.

* * * * *